US012680390B2

(12) United States Patent
Khan et al.

(10) Patent No.: US 12,680,390 B2
(45) Date of Patent: Jul. 14, 2026

(54) SYSTEMS AND METHODS FOR OPTIMIZING LATERAL LANDING FOR EXPLORATIONAL ENVIRONMENTS

(71) Applicant: Schlumberger Technology Corporation, Sugar Land, TX (US)

(72) Inventors: Abdul Muqtadir Khan, Stafford, TX (US); Gagok Imam Santoso, Dhahran (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 167 days.

(21) Appl. No.: 18/431,326

(22) Filed: Feb. 2, 2024

(65) Prior Publication Data

US 2024/0263517 A1 Aug. 8, 2024

Related U.S. Application Data

(60) Provisional application No. 63/483,048, filed on Feb. 3, 2023.

(51) Int. Cl.

| | |
|---|---|
| ***E21B 7/04*** | (2006.01) |
| ***E21B 41/00*** | (2006.01) |
| ***E21B 49/08*** | (2006.01) |

(52) U.S. Cl.

CPC ..... *E21B 7/04* (2013.01); *E21B 41/00* (2013.01); *E21B 49/08* (2013.01)

(58) Field of Classification Search

CPC ..... E21B 7/04; E21B 41/00; E21B 44/00

See application file for complete search history.

(56) References Cited

U.S. PATENT DOCUMENTS

2022/0316327 A1* 10/2022 Al-AbdulJabbar ..... E21B 49/00

FOREIGN PATENT DOCUMENTS

WO 2016100762 A1 6/2016

OTHER PUBLICATIONS

Almulhim, A. et al., "A Novel Stimulation Design Approach Revives a Challenging Gas Field", SPE-202427-MS, prepared for presentation at the SPE Asia Pacific Oil Gas Conference and Exhibition, 2020, 20 pages.

(Continued)

*Primary Examiner* — Tara Schimpf
*Assistant Examiner* — Lamia Quaim
(74) *Attorney, Agent, or Firm* — Jeffrey D. Frantz

(57) ABSTRACT

Systems and methods presented herein include a method that includes conducting a parametric production study for a plurality of wells during a development phase of the plurality of wells in a geological environment. The method also includes deploying information relating to the parametric study for use in design of an additional well. The method further includes analyzing production intervals of the plurality of wells and the additional well to determine a best production interval. In addition, the method includes analyzing production dependence of the plurality of wells and the additional well on precise lateral landing. The method also includes identifying a precise sublayer for lateral landing based at least in part on the best production interval and the production dependence. The method further includes geosteering a lateral of the additional well in accordance with information relating to the precise sublayer for lateral landing.

20 Claims, 20 Drawing Sheets

(56) References Cited

OTHER PUBLICATIONS

Al-Qasim, A. et al., "Monitoring and Surveillance of Subsurface Multiphase Flow and Well Integrity" Upstream Oil and Gas Technology, 2020, 5, pp.
Cipolla, C. et al. "New Algorithms and Integrated Workflow for Tight Gas and Shale Completions", SPE-146872-MS, presented at the SPE Annual Technical Conference, Denver, Colorado, 2011, 18 pages.
Hassan, N. A. et al., "Refactoring Carbonate Reservoir Architecture through Real-Time LWD Measurement", SPE-186443-MS, presented at the SPE/IATMI Asia Pacific Oil Gas Conference and Exhibition, Jakarta, Indonesia, 2017, 14 pages.
Khan, A. M. et al., "Predictive Regression Model for Fracturing Fluid Efficiency—Design and Validation Workflow Based on Machine Learning", SPE-202544-MS, presented at the SPE Annual Caspian Technical Conference, Virtual Event, 2020, 18 pages.
Sharma, M. M. et al. "Slick Water and Hybrid Fracs in the Bossier: Some Lessons Learnt", SPE-89876-MS, SPE Annual Technical Conference and Exhibition, 2004, 12 pages.

* cited by examiner

SYSTEMS AND METHODS FOR OPTIMIZING LATERAL LANDING FOR EXPLORATIONAL ENVIRONMENTS

CROSS-REFERENCE TO RELATED APPLICATION

The present patent application claims priority to and the benefit of U.S. Provisional Patent Application No. 63/483,048, entitled "SYSTEMS AND METHODS FOR OPTIMIZING LATERAL LANDING FOR EXPLORATIONAL ENVIRONMENTS" and filed on Feb. 3, 2023, the disclosure of which is incorporated by reference herein in its entirety for all purposes.

BACKGROUND

The present disclosure generally relates to systems and methods for implementing a full lateral landing optimization workflow for explorational environments.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

For unconventional, tight gas, and low permeability conventional reservoirs, horizontal wells are very important to optimize production potential. Moreover, fracturing and stimulation also becomes very important. Several challenges are frequent to the production and well engineering workflows including, but not limited to: (1) placing a lateral precisely, (2) optimizing the perforation placement (e.g., in case of a cased hole well), and (3) optimizing the placement of packers and fracturing sleeves (e.g., in case of openhole fracturing completions).

Conventional analysis methods involve conducting reservoir characterization from the pilot hole data, constructing one-dimensional Mechanical Earth Model (MEM) calculations and adding them to openhole logs followed by fracturing simulations using a fine resolution commercial model (e.g., Pseudo3D or Planar3D) to sensitize fracture height coverage within the target reservoir layer to identify lateral landing points (LLP) and run fracture geometry simulations with expected pumping schedules. A problem with this approach is the assumption of lateral heterogeneity (e.g., geomechanical and mineralogical) across the lateral, which has a significant impact on the height growth and reservoir connectivity with the wellbore.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method that includes conducting a parametric production study for a plurality of wells during a development phase of the plurality of wells in a geological environment. The method also includes deploying information relating to the parametric study for use in design of an additional well. The method further includes analyzing production intervals of the plurality of wells and the additional well to determine a best production interval. In addition, the method includes analyzing production dependence of the plurality of wells and the additional well on precise lateral landing. The method also includes identifying a precise sublayer for lateral landing based at least in part on the best production interval and the production dependence. The method further includes geosteering a lateral of the additional well in accordance with information relating to the precise sublayer for lateral landing.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
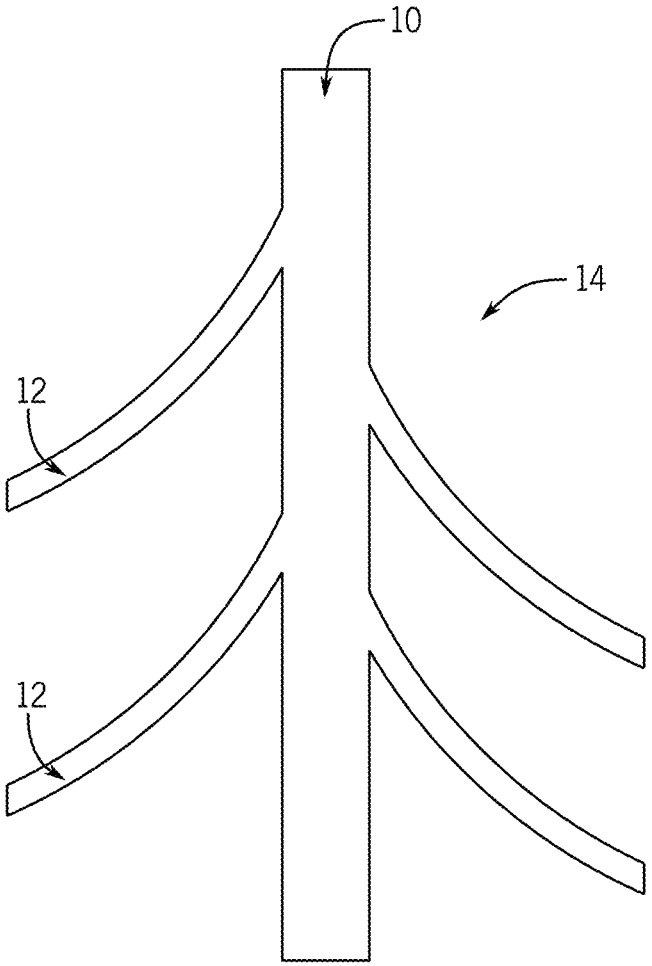
FIG. 1 illustrates a main borehole having multiple lateral boreholes extending therefrom and having curved trajectories, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements; in other words, these terms are used in an open-ended fashion, and thus should be interpreted to mean "including, but not limited to . . . " Additionally, it should be understood that references to "one embodiment" or "an embodiment" of the present disclosure are not intended to be interpreted as excluding the existence of additional embodiments that also incorporate the recited features. Furthermore, the phrase "A based on B" is intended to mean that A is at least partially based on B. Moreover, unless expressly stated otherwise, the term "or" is intended to be inclusive (e.g., logical OR) and not exclusive (e.g., logical XOR). In other words, the phrase "A or B" is intended to mean A, B, or both A and B.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic", "automated", "autonomous", and so forth, are intended to describe operations that are performed or caused to be performed, for example, by a computing system (i.e., solely by the computing system, without human intervention). Indeed, it will be appreciated that the well control system described herein may be configured to perform any and all of the data processing functions described herein automatically.

In addition, as used herein, the term "substantially similar" may be used to describe values that are different by only a relatively small degree relative to each other. For example, two values that are substantially similar may be values that are within 10% of each other, within 5% of each other, within 3% of each other, within 2% of each other, within 1% of each other, or even within a smaller threshold range, such as within 0.5% of each other or within 0.1% of each other.

Similarly, as used herein, the term "substantially parallel" may be used to define downhole tools, formation layers, and so forth, that have longitudinal axes that are parallel with each other, only deviating from true parallel by a few degrees of each other. For example, a downhole tool that is substantially parallel with a formation layer may be a downhole tool that traverses the formation layer parallel to a boundary of the formation layer, only deviating from true parallel relative to the boundary of the formation layer by less than 5 degrees, less than 3 degrees, less than 2 degrees, less than 1 degree, or even less.

The embodiments of the present disclosure provide systems and methods for implementing a full lateral landing optimization workflow for explorational environments. However, it should be noted that the embodiments described herein may be performed for explorational phases, appraisal phases, development phases, other asset development phases, or any other phases of oil and gas exploration and production. In addition, the embodiments described herein are equally applicable to conventional geologic environments, unconventional geologic environments, or any other type of geologic environments.

Figure 2:
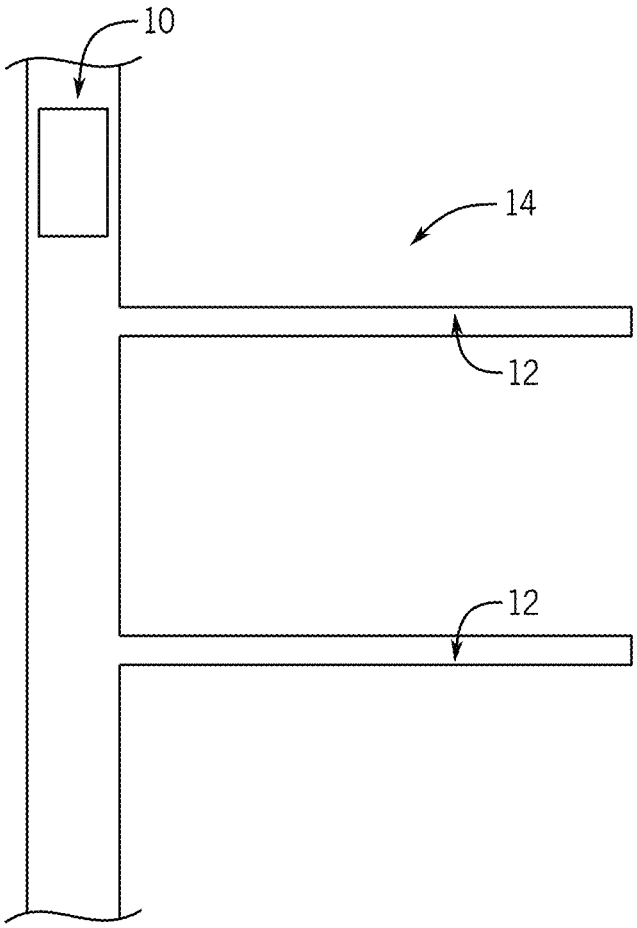
FIG. 2 illustrates a main borehole having multiple lateral boreholes extending orthogonally therefrom, in accordance with embodiments of the present disclosure.
Figure 3:
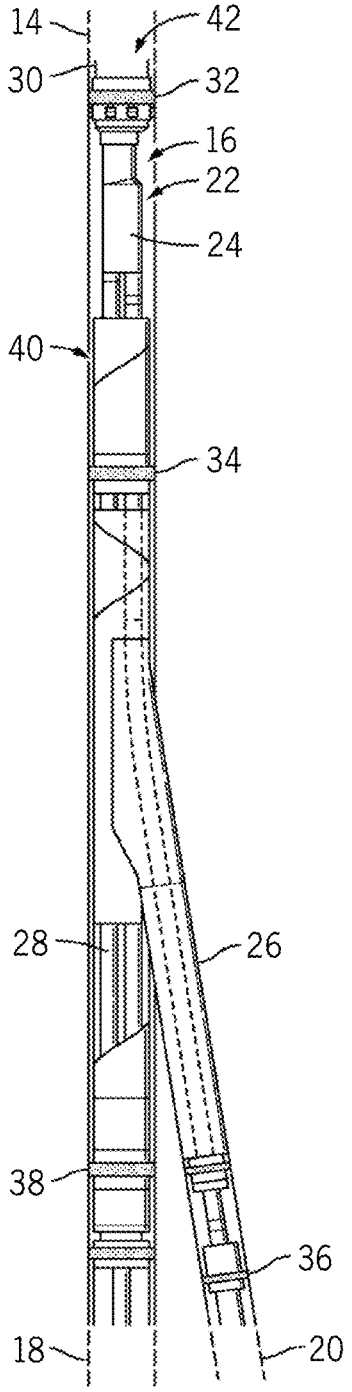
FIG. 3 illustrates an example well completion system deployed in a multilateral well having a main bore leg and a lateral bore leg similar to the well illustrated in FIG. 1, in accordance with embodiments of the present disclosure.
Figure 5:
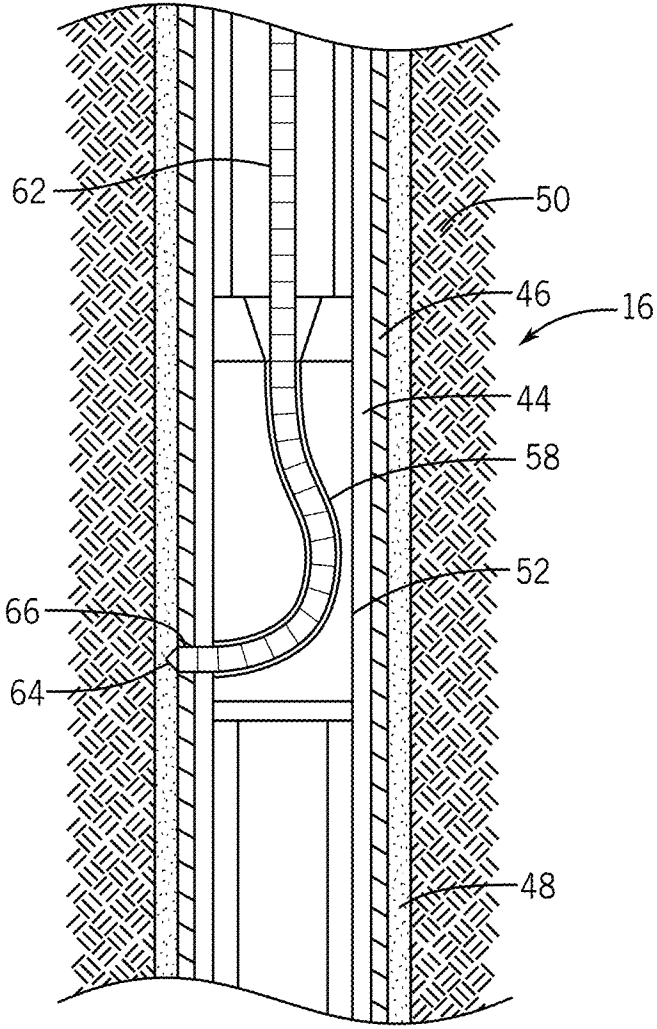
FIGS. 4 and 5 illustrate a portion of another example well completion system deployed in a multilateral well similar to the well illustrated in FIG. 2, in accordance with embodiments of the present disclosure.
Figure 4:
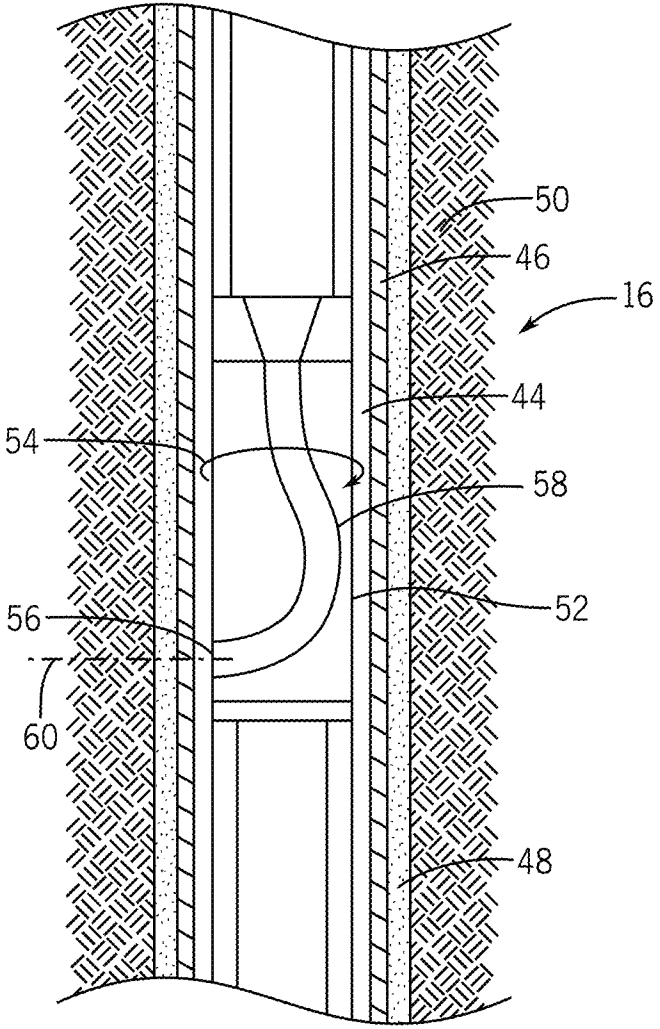

FIGS. 1 and 2 each illustrate a main borehole 10 that may have multiple lateral boreholes 12 extending therefrom. In many cases, a conventional curved trajectory may be used for the laterals 12 (see FIG. 1) giving a fishbone arrangement when seen in two dimensions. It may also be useful for the laterals 12 to extend directly (e.g., substantially orthogonally) away from the main borehole 10 (see FIG. 2). The laterals 12 may be placed at different angles relative to the main well 14. FIGS. 3-5 illustrate more detailed views of example multilateral wells 14 similar to those illustrated in FIGS. 1 and 2.

For example, FIG. 3 illustrates an example well completion system 16 deployed in a multilateral well 14 having a main bore leg 18 and a lateral bore leg 20 similar to the well 14 illustrated in FIG. 1. Depending on the application, in certain embodiments, the well 14 may have multiple lateral bores 20. In addition, in certain embodiments, the well completion system 16 may include a variety of well systems utilizing joined tubular components. In certain embodiments, the well completion system 16 may include tubular components employed in non-well related applications (e.g. surface tubing applications). In the illustrated embodiment, the well completion system 16 includes a Y-block 22 disposed in the well 14 and having a pressure housing 24.

In certain embodiments, a lateral tubing string 26 may be coupled to the pressure housing 24 of the Y-block 22 and extend into the lateral bore 20 of the multilateral well 14. In addition, in certain embodiments, a main tubing string 28 may be coupled to the pressure housing 24 of the Y-block 22 and extend downhole into the main bore 18. In addition, in certain embodiments, an uphole tubing string 30 may also be coupled to the pressure housing 24 of the Y-block 22 and extend uphole toward the surface. In certain embodiments, each of the lateral tubing string 26, the main tubing string 28, and the uphole tubing string 30 may be sealingly coupled (e.g, pressure sealed) with the pressure housing 24 of Y-block 22.

In a variety of applications, packers may be employed to seal off sections of the wellbore between the tubing strings 26, 28, 30 and the surrounding wellbore wall. For example, in certain embodiments, a production packer 32 may be employed uphole (e.g., above) the Y-block 22 and an additional packer 34 may be deployed downhole (e.g., below) the Y-block 22. Additional packers may be deployed in the legs of the multilateral well 14. For example, in certain embodiments, a packer 36 may be deployed in the lateral bore 20 and a corresponding packer 38 may be deployed in the main bore 18 downhole from a junction 40 between the lateral tubing string 26 and the main tubing string 28. The Y-block 22 and the various tubular components and other components of the lateral tubing string 26, the main tubing string 28, and the uphole tubing string 30 form a multilateral completion 42 deployed in the multilateral well 14.

In addition, FIGS. 4 and 5 illustrate a portion of another example well completion system 16 deployed in a multilateral well 14 similar to the well 14 illustrated in FIG. 2. For example, FIG. 4 illustrates a portion of a main wellbore 44 (e.g., main borehole 10) including a casing 46 (which may be secured by cement 48 or installed open-hole) extending through a subterranean formation 50. In certain embodiments, the well completion system 16 may include a deflecting device 52 (e.g., deflector shoe) operable to deflect or otherwise direct a drilling, cutting, or other boring device toward a sidewall of the main wellbore 44 to create a perforation lateral tunnel (e.g., lateral borehole 12). In certain embodiments, the deflecting device 52 may be rotatably oriented with respect to the main wellbore 44, as indicated by arrow 54, to rotatably align or orient an outlet port 56 of an internal passage 58 of the deflecting device 52 in an intended direction (e.g., a substantially vertical direction). In certain embodiments, an axis 60 of the outlet port 56 may be oriented substantially orthogonal (e.g., within 5 degrees, within 2 degrees, within 1 degree, or even closer, to exactly orthogonal) to the casing 46 through which the perforation lateral tunnel extends.

As illustrated in FIG. 5, in certain embodiments, after the deflecting device 52 is positioned at an intended longitudinal (e.g., axial) location within the main wellbore 44 and at an intended rotational orientation, a flexible drilling assembly 62 terminating with a drilling, milling, cutting, or other bit 64 may be deployed through the internal passage 58 of the well completion system 16 to create a perforation 66 (i.e., a hole) through the casing 46. After the perforation lateral tunnel is created, the deflecting device 52 may be reoriented to create another perforation lateral tunnel or moved longitudinally along the main wellbore 44 to a selected location. The process may be repeated until the intended number of perforation lateral tunnels are created along the entire main wellbore 44.

Figure 6:
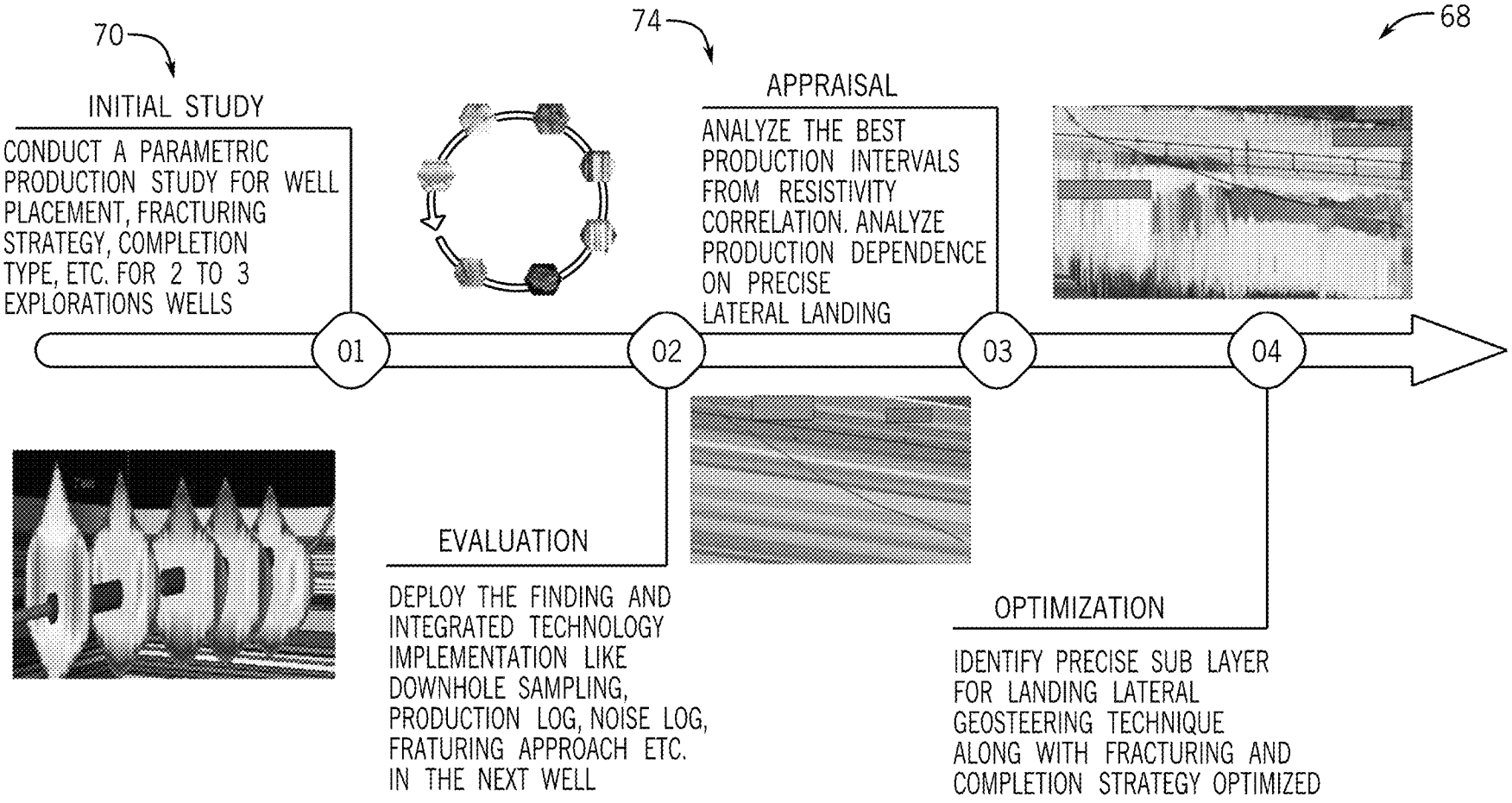
FIG. 6 illustrates a full lateral landing optimization workflow for development of challenging exploration areas, in accordance with embodiments of the present disclosure.
Figure 7:
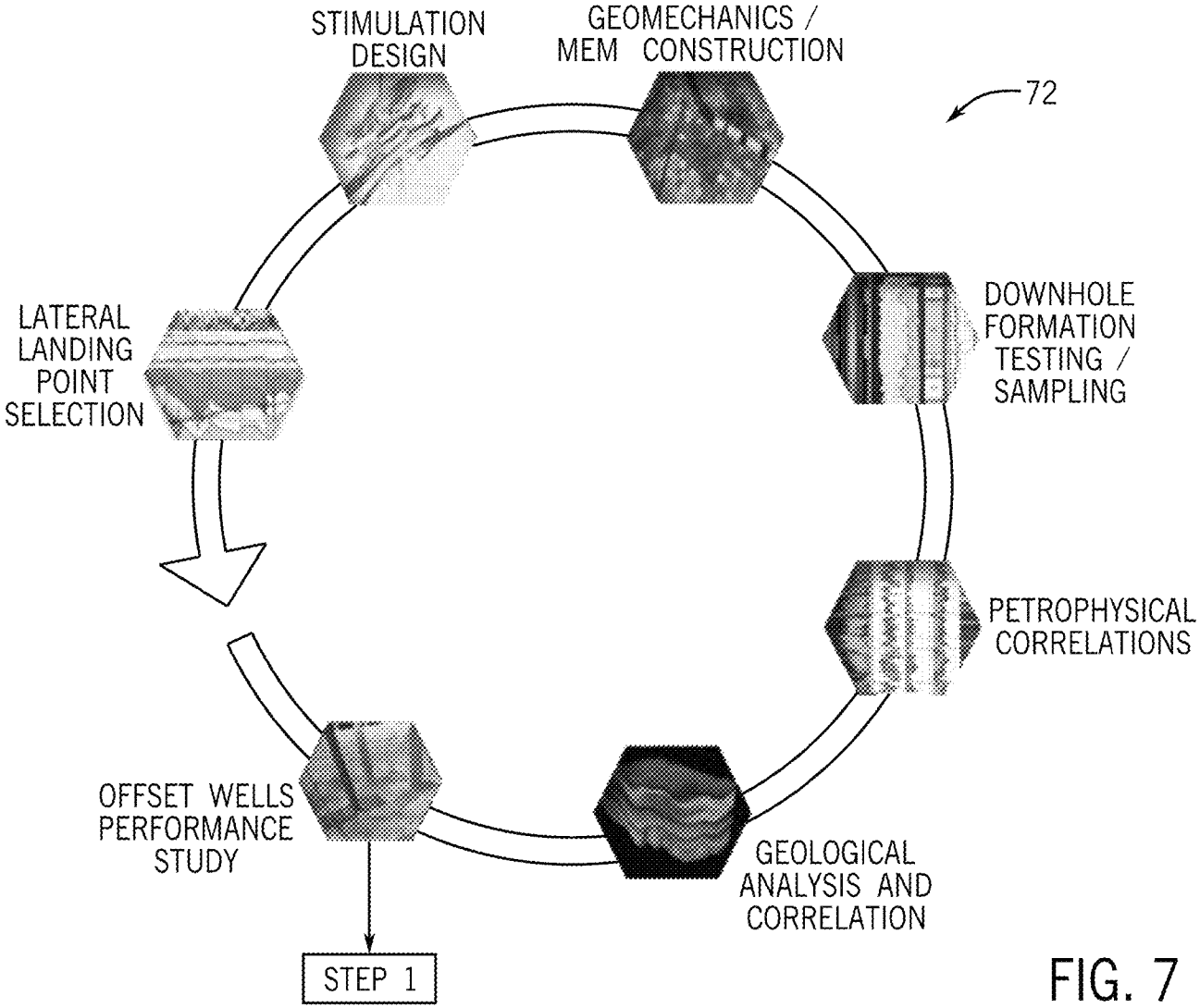
FIG. 7 illustrates a lateral landing workflow from vertical pilot hole analysis for a well as part of an evaluation stage of the workflow of FIG. 6, in accordance with embodiments of the present disclosure.

As illustrated in FIG. 6, the embodiments described herein provide a novel full lateral landing optimization workflow 68 that generally includes four main steps. As illustrated, in certain embodiments, the workflow 68 may include an initial study 70 (Step 1). In certain embodiments, after 'n' number of wells have been finalized, a detailed parametric study may be performed to investigate a few or all of the below parameters, among other parameters, and create correlation indices to comprehend impact of different components on production:

1. Completion type
2. Number of fracturing stages
3. Differential azimuth of the lateral from preferential fracture plane
4. Lateral landing point in subsurface total vertical depth reference
5. Amount of polymer used
6. Fracture geometry with net pressure match
7. Post fracturing hydrocarbon rate
8. Post fracturing drawdown pressure
9. Post fracturing productivity index Then, in certain embodiments, the workflow 68 may also include evaluation 72 (Step 2). After the parametric productivity study on n wells in the exploratory phase, the $(n+1)^{th}$ well may incorporate the analysis and knowledge derived from the initial study 70 (Step 1). FIG. 7 illustrates a lateral landing workflow from vertical pilot hole analysis for well 'n+1' as part of the evaluation 72 (step 2). As illustrated in FIG. 7, in certain embodiments, the lateral landing workflow may include geological analysis and correlation, petrophysical correlations, downhole formation testing and sampling, geomechanics and Mechanical Earth Model (MEM) construction, stimulation design, lateral landing point selection, and offset wells performance study, among other domains. The multi-domain workflow illustrated in FIG. 7 has been devised and adopted to understand the geological correlations, petrophysical correlations, and so forth, from formation samples that were acquired from a target reservoir layer for fluid mobility to supplement the porosity and permeability interpretations from openhole logs. The acoustic logs may be utilized to construct a robust one-dimensional MEM with calibrated correlations. The rock characterization and log QA/QC may be performed after that.

Returning now to FIG. 6, in certain embodiments, the workflow 68 may also include appraisal 74 (Step 3). The success of $(n+1)^{th}$ well may then be used to support the developmental phase of the offset area by new horizontal wells drilling into the prolific layer (which has been analyzed), followed by multistage fracturing. Two to three more wells may be used for this phase to complete and fracture with variable strategies and analyze the production performance. Production results analyzed together with production logs may be utilized to generate and integrate "lookback". At this point, the challenge of achieving good fracture conductivity across the fracture height away from the wellbore, as well as disparity in the production performance among different wells, may be considered. In certain embodiments, lateral trajectory model correlations through a two-dimensional curtain section with geological layering may be generated. All of the acquired log data, fracturing treatment evaluation, and other information may be used together with this lateral trajectory model to comprehend the production performance.

Figure 8:
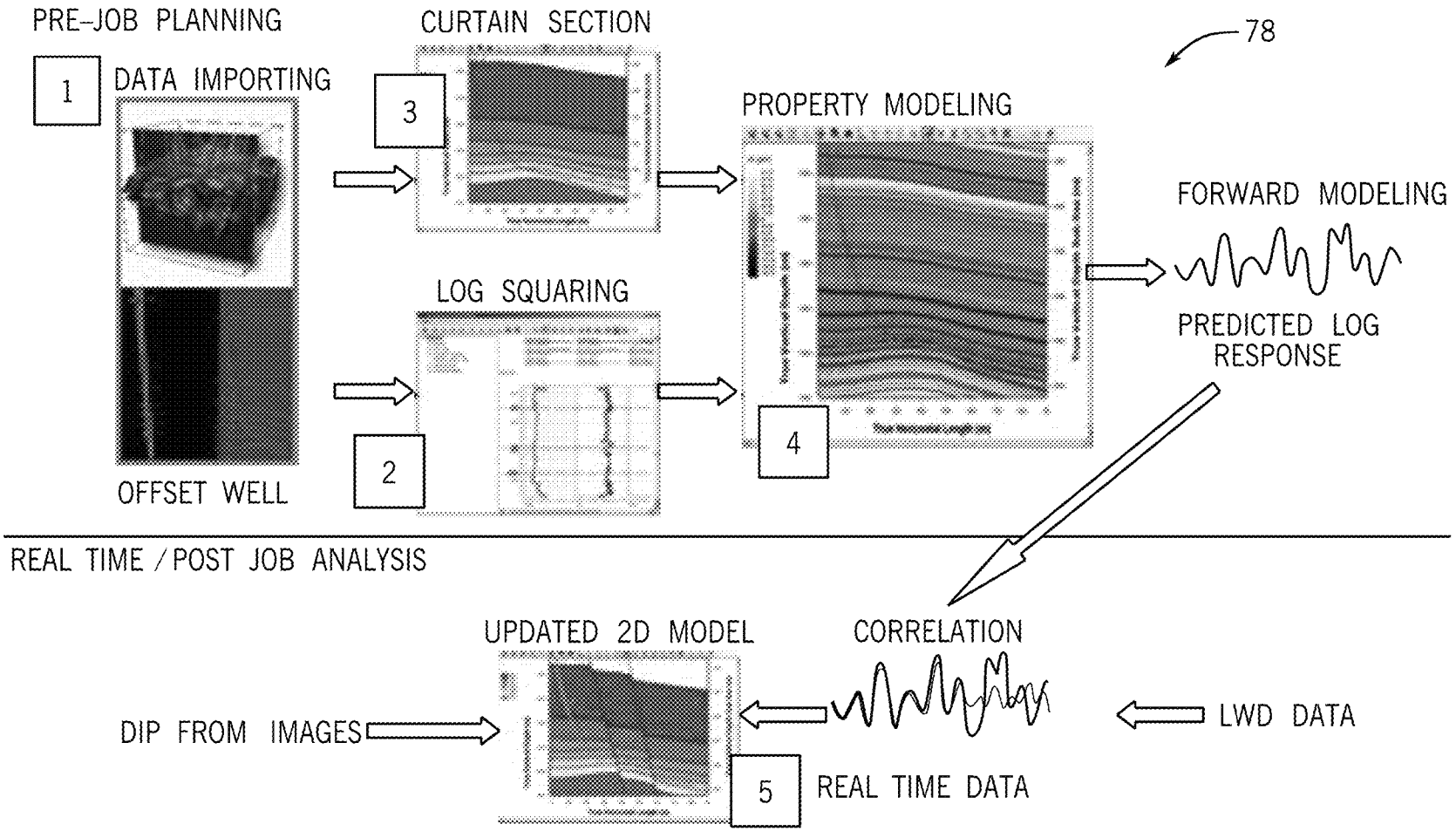
FIG. 8 illustrates a curtain section generation workflow associated with the workflow of FIG. 6, in accordance with embodiments of the present disclosure.
Figure 9:
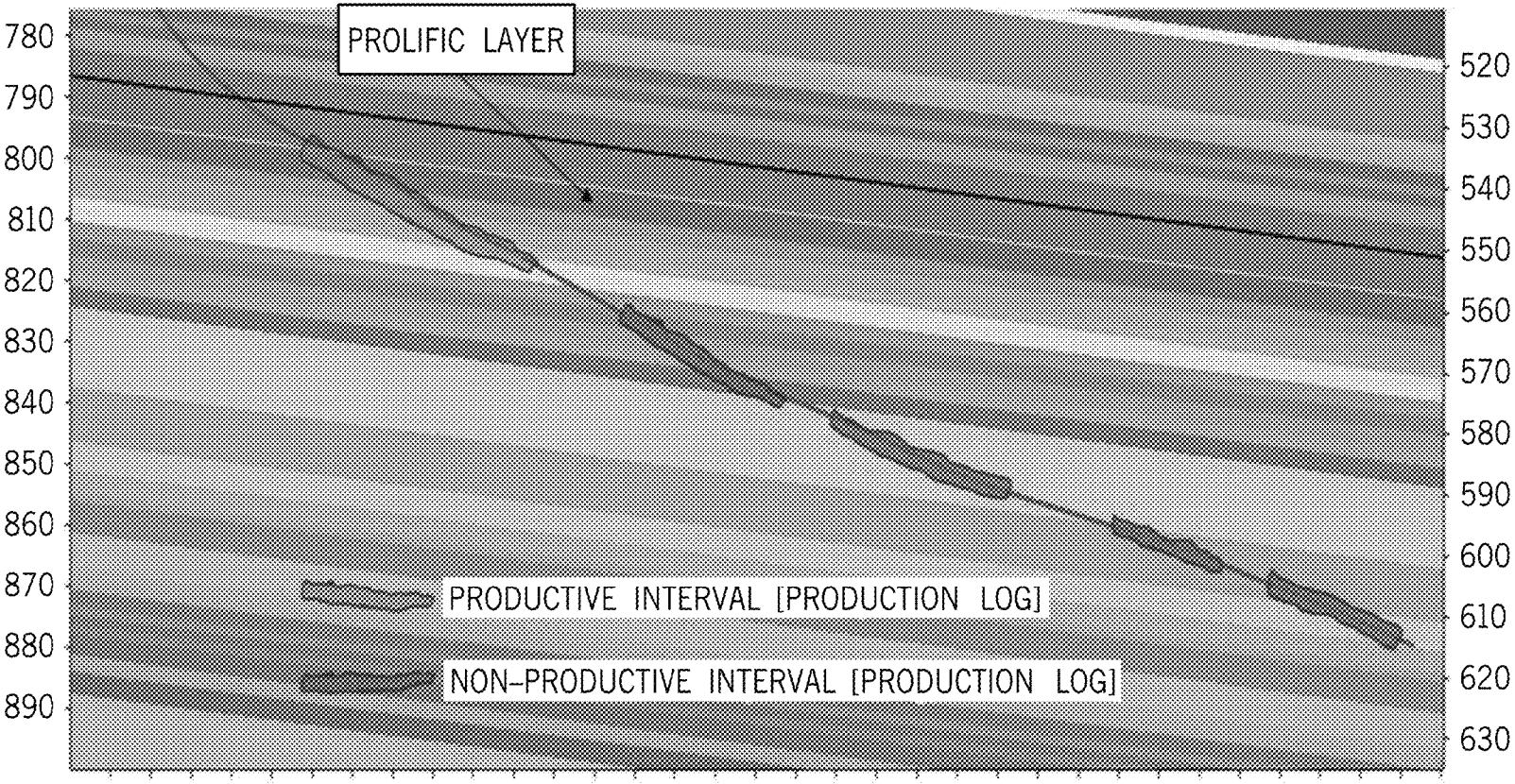
FIG. 9 illustrates fracturing stage placement with production prediction associated with the workflow of FIG. 6, in accordance with embodiments of the present disclosure.
Figure 10:
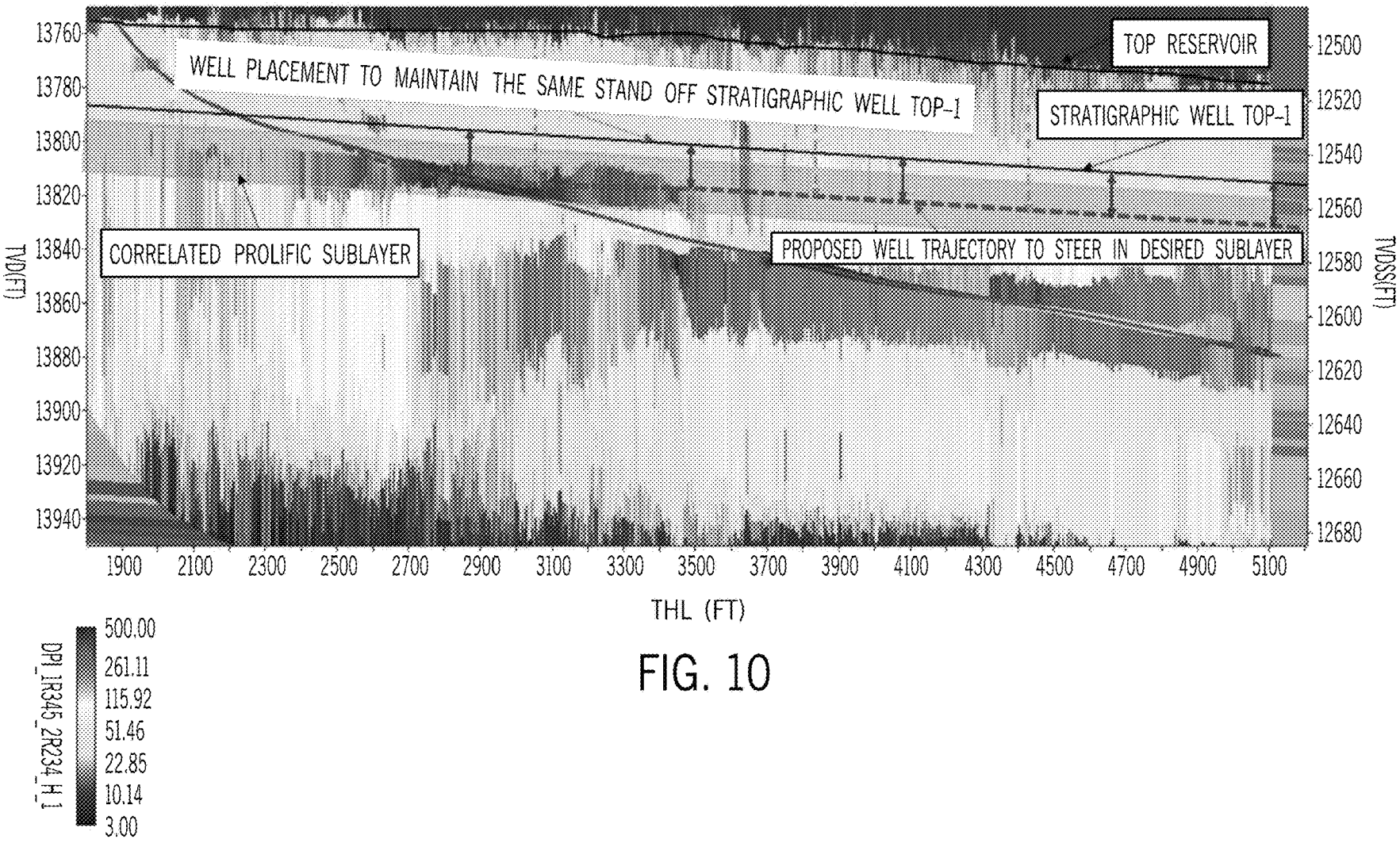
FIG. 10 illustrates ultradeep mapping technology, in accordance with embodiments of the present disclosure.

FIG. 8 illustrates a curtain section generation workflow 78, and FIG. 9 illustrates fracturing stage placement with production prediction, where the most prolific sublayer may be analyzed based on the best producer using production logging tools. In certain embodiments, the $n+2^{th}$, $n+3^{th}$, and $n+4^{th}$ wells may be analyzed to establish production correlation based on below lateral landing point analysis, which may include:

1. Percent intersection of total lateral with the prolific layer
2. Vertical distance of the lateral from the prolific layer (e.g., the conductive fracture height)
3. Proppant fractured clusters/intervals Returning now to FIG. 6, in certain embodiments, the workflow 68 may also include optimization 76 (Step 4). In this final step for all future wells, the data described above may be used to realize the conductive fracture height, mentioned above, and deep azimuthal resistivity mapping may be utilized to geosteer laterals based on analyzed outputs. FIG. 10 illustrates ultradeep mapping technology, which may be used to delineate the target reservoir and enable geosteering.

Real-World Well Analysis

The workflow 68 and its associated sub-workflows illustrated in FIGS. 6-18 and described in the corresponding paragraphs will now be presented as applied to real-world wells to enable better understanding of the workflow 68 and its associated sub-workflows. In particular, three horizontal wells were drilled and completed with hydraulic fracturing in an explorational environment based on reservoir characterization from openhole logs. Limited success in establishing gas production rates showed the need for an integrated technical workflow to be applied for the next well, Well-A. After good production results were achieved in Well-A, the next phase used three more wells to correlate the production performance based on precise well placement.

In Well-A, openhole sampling was performed during drilling of the pilot hole prior to sidetracking the lateral. This was followed by a novel fracturing approach with slickwater hybrid, low-polymer, and $CO_2$ foamed treatments to study the effectiveness of the treatments. Post-fracturing diagnostics were performed to assess production by stage. Three more wells were then drilled in the same reservoir, and a synthetic correlation model was built with resistivity logs to correlate precise lateral landing with the prolific sublayer. Finally, the production performance of all of the wells was studied based on well placement, fracturing, and the completion approach.

The first phase of the study of the three wells allowed characterizing Well-A in terms of reservoir interval, wellbore orientation, and fracturing strategy. Layer-1 was used to sidetrack the lateral. The next three wells in the development phase were drilled in layer-1 with good production but inconsistent results. Because the highest flow rate in Well-A was seen from the heel part of the lateral, an ultradeep resistivity-correlation bed boundary model was generated from Well-A to characterize structural dip, and precise lateral locations were analyzed for all the wells. The model was also used to describe the most prolific sublayer within the layer-1 reservoir. The results showed a strong production dependence on the lateral landing with respect to the defined prolific sublayer. The number of fractures placed also showed a direct relation with gas rates. Finally, a geosteering simulation model was built to be used to further develop the area, and detailed recommendations were documented. The ultradeep azimuthal resistivity tool has the capacity to detect ultradeep resistivity up to 100 feet from the borehole. Simultaneously, it can map ultrathin layers, which is necessary for the laminated reservoirs.

After a relative lack of consistent success in exploiting production potential, three horizontal gas wells—wells B, C, and D—were studied for production performance after fracturing of a clastic sandstone formation in an exploration area (Table 1). Well-B produced at a commercial gas rate, and the main difference between Well-B and the other wells was the target stratigraphic interval. Stratigraphic layer-1 is 130-150 feet thick across the section. Well-B was drilled in a stratigraphic layer-1 intersection 50-foot of gross pay interval, and the other two wells were drilled in layer-2. The second difference was completion type, which is primarily dictated by the hole quality experienced during drilling. For example, a drilled section with multiple washed out intervals is more suitable for completion with a cemented liner. The third difference was the amount of polymer pumped along with the fracturing fluid. The fourth and the final difference was the wellbore orientation. The differential azimuth in Table 1 is defined as the difference between the wellbore azimuth and preferential fracture plane (i.e., maximum horizontal stress azimuth). In most cases, the closer the differential azimuth tends to 90°, the greater the transverse propagation of the hydraulic fractures. Guar polymer is relative damaging to the fracture conductivity, and reducing the amount of the polymer could affect the production performance. Gas Well-A was then completed with a cemented lateral sidetracked into layer-1. It was also decided to deploy a robust engineering workflow to better understand the parameters that influenced production for the future development of this challenging area.

TABLE 1

Candidate offset summary.

| | Completion Method | Number of Stages | Differential Azimuth [deg] | Amount of Polymer [lbm] | Normalized Gas Rate | Normalized Flowing Wellhead Pressure |
|---|---|---|---|---|---|---|
| Well-B | Openhole multistage fracturing | 5 | 40 | 17,600 | 1.00 | 1.00 |
| Well-C | Plug and perf | 5 | 80 | 38,400 | 0.18 | 0.19 |
| Well-D | Plug and perf | 4 | 75 | 16,800 | 0.00 | 0.00 |

The analysis described above constituted the first evaluation cycle of this study. A second analysis phase was conducted to correlate the effect of precise lateral landing on production. Wells E, F, and G, also sidetracked in layer-1, were analyzed for inconsistent production performance. The effect of induced fracture density (number of stages), completion type, and other factors, were also investigated to find an appropriate strategy. The workflow employed in Well-A included modular dynamic testing to collect real-time downhole samples and post-fracturing production logging to make correlations for the other offset wells. The downhole sampling aided in identifying precise lateral landing point within the net pay.

Figure 11:
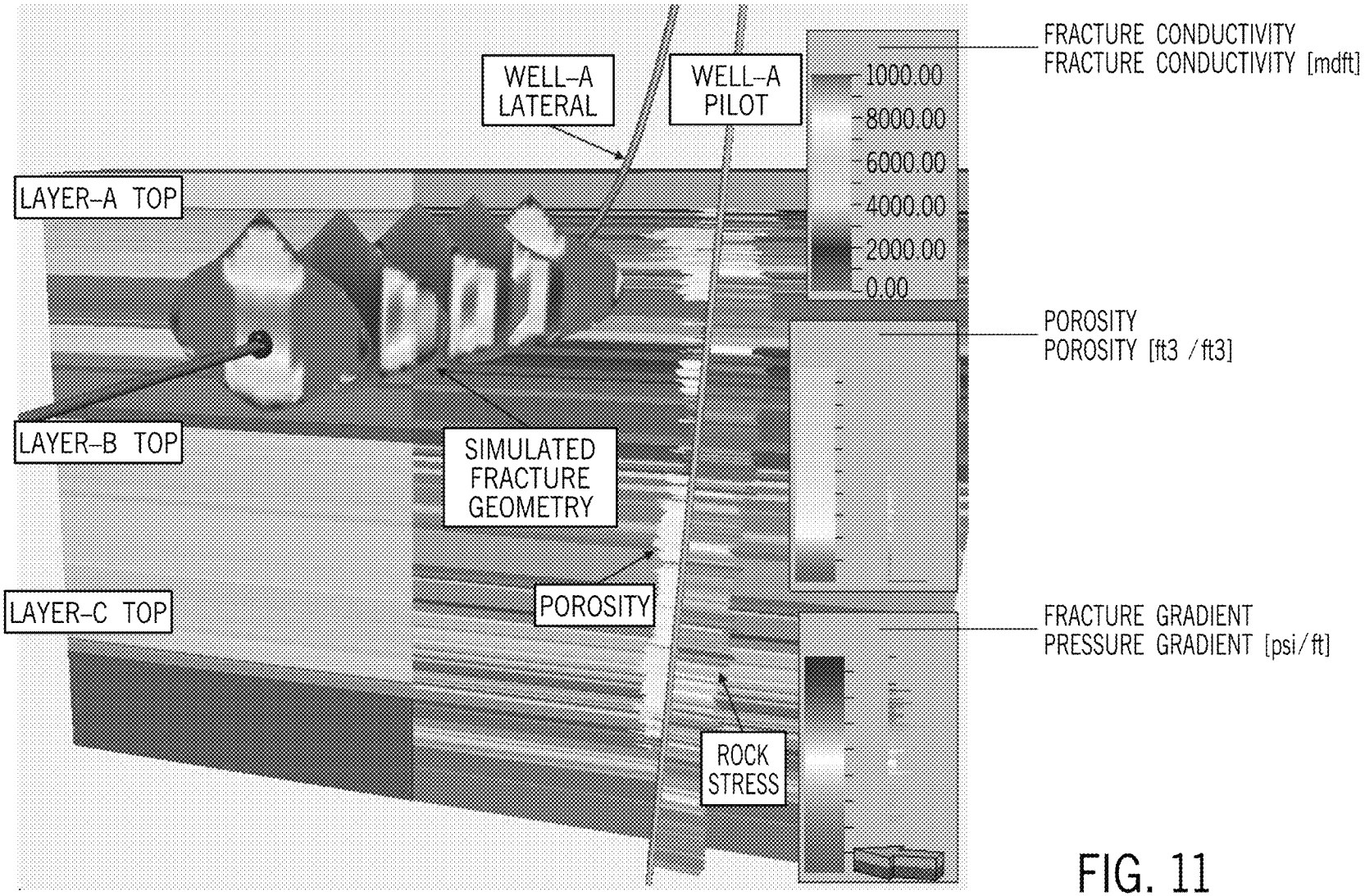
FIG. 11 illustrates fracture geometry evaluation showing reservoir layering in perspective across a vertical section and shows a lateral being landed in a low stress interval, in accordance with embodiments of the present disclosure.

FIG. 11 illustrates the reservoir layering in perspective across the vertical section and shows the lateral being landed in the low stress interval. After Well-B was concluded, a post-fracturing net pressure match evaluation was performed to investigate the fracture height growth. The inverse matching was conducted with a P3D model after calibrating the zoneset and leakoff. The fracture conductivity across its geometry can be seen. The fracture height growth was estimated up to 100 feet, which shows high fracture containment due to thin laminated layers in this clastic rock section. However, only about 50 feet of fracture height showed relatively good conductivity (e.g., approximately 20-25 feet above and below the lateral). Also, due to the azimuth of the lateral, the fractures were approximately 50° oblique to the wellbore. The challenge in this environment is always to achieve high conductivity due to conservative proppant schedules allowed by extremely high treating pressures of up to 20,000 psi.

First Phase: Evaluation

The evaluation phase that started with the offset study was implemented with a robust engineering workflow for Well-A. The lateral was drilled horizontally in a dry gas reservoir with a low condensate gas ratio. A pilot hole was first drilled with the full openhole log suite, including downhole sampling. The lateral landing point was selected based on the previous study of the prolific sublayer (layer-1) and good mobility downhole samples were acquired. Based on the pilot hole data analysis, lateral landing interval, openhole logs for the lateral, reservoir quality, and completion quality indicators, it was decided to complete with eight stages of fracturing treatment using plug-and-perf techniques. A novel fracturing strategy was used to target the potential problems and compare the effectiveness of stimulation. Some relevant highlights from the first evaluation loop of the workflow described herein will be presented below.

Lateral Landing and Horizontal Section

As mentioned above, the production study done in the exploratory phase revealed layer-1 to be the prolific section. The multi-domain workflow 72 illustrated in FIG. 7 was devised and adopted to understand the geological correlations, petrophysical correlations, and so forth, from formation samples acquired from layer-1 for fluid mobility to supplement the porosity and permeability interpretations from openhole logs. The rock characterization and log QA/QC was performed after that. The acoustic logs were utilized to construct a robust one-dimensional Mechanical Earth Model (MEM) with calibrated correlations.

Figure 12:
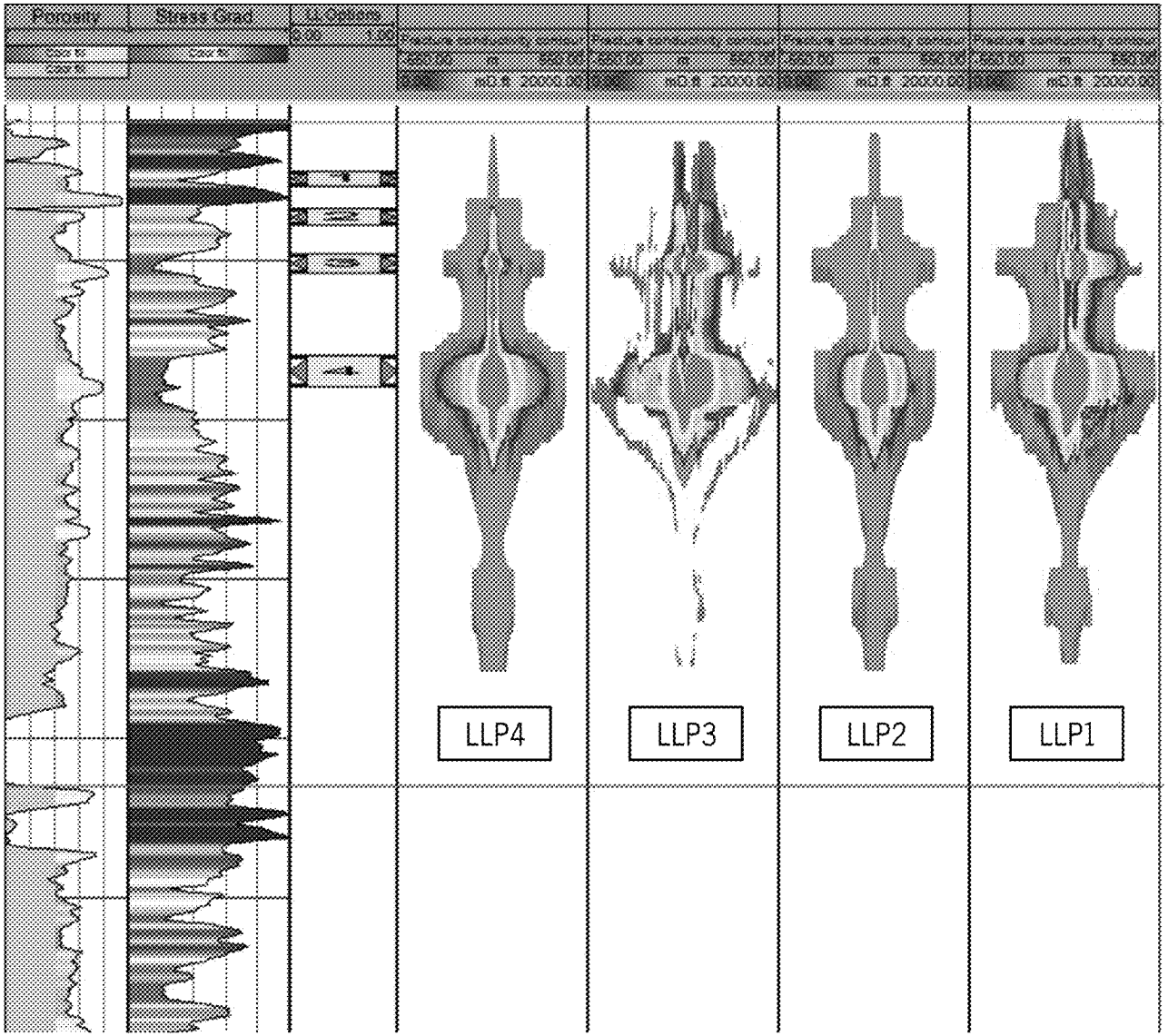
FIG. 12 is a montage of the full high-tier log suite with an open hole log including a spectral gamma ray (GR) log used to analyze the lithology fractions through elemental spectroscopy, in accordance with embodiments of the present disclosure.

After the reservoir characterization exercise was conducted in the pilot hole, fracturing simulations were performed using a fine resolution Planar3D model to sensitize fracture height coverage within the full layer-1. FIG. 12 is a montage of the full high-tier log suite with an open hole log including a spectral gamma ray (GR) log used to analyze the lithology fractions through elemental spectroscopy. In particular, FIG. 12 illustrates PL3D fracture simulations at four potential initiation points within layer-1 pay interval. Also, the one-dimensional MEM was added to the openhole logs to identify four suitable lateral landing points (LLP1, LLP2, LLP3, and LLP4) and run fracture geometry simulations with the expected pumping schedules. FIG. 12 illustrates pinch points and fracture height coverage through the conductivity contours. It was observed that the fracture heights were very contained and, although most of the layer-1 was hydraulically fractured, the upper part of the layer-1 was not achieving a high fracture conductivity.

Consequently, it was decided to sidetrack from LLP1 and intersect across the four landing point intervals. This strategy was chosen to effectively connect the layer-1 because all the initiations showed similar height growth and LLP1 was the depth with the highest mobility gas sample analyzed from the formation testing tool. A planned and final trajectory for the lateral across the two-dimensional curtain section was sensitized in perspective of the four LLPs. The lateral intersected approximately 70 foot of vertical net pay. The deviation across the horizontal was approximately 88° at a differential azimuth of approximately 28°. The fracture propagation was expected mostly along the wellbore, slightly oblique.

Figure 13:
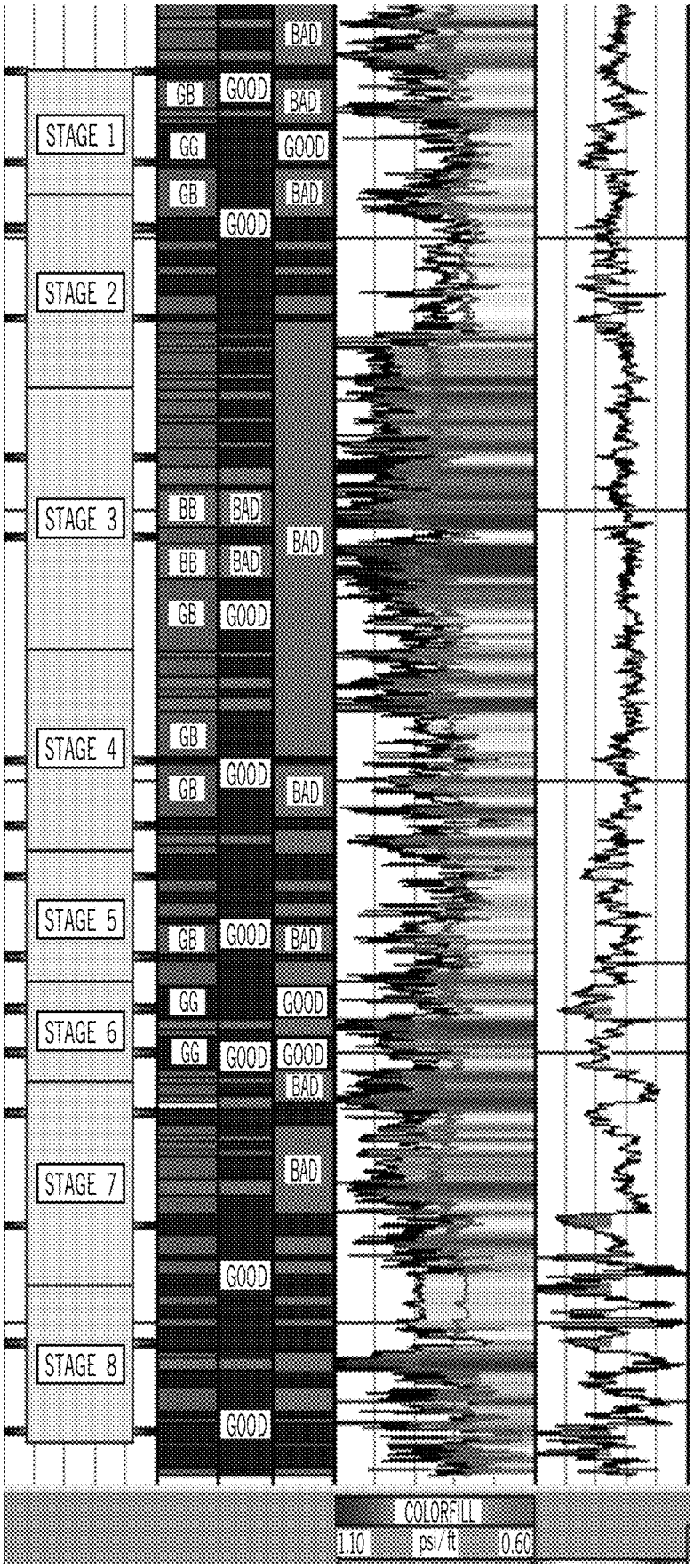
FIG. 13 illustrates a completion workflow, in accordance with embodiments of the present disclosure.
Figure 14:
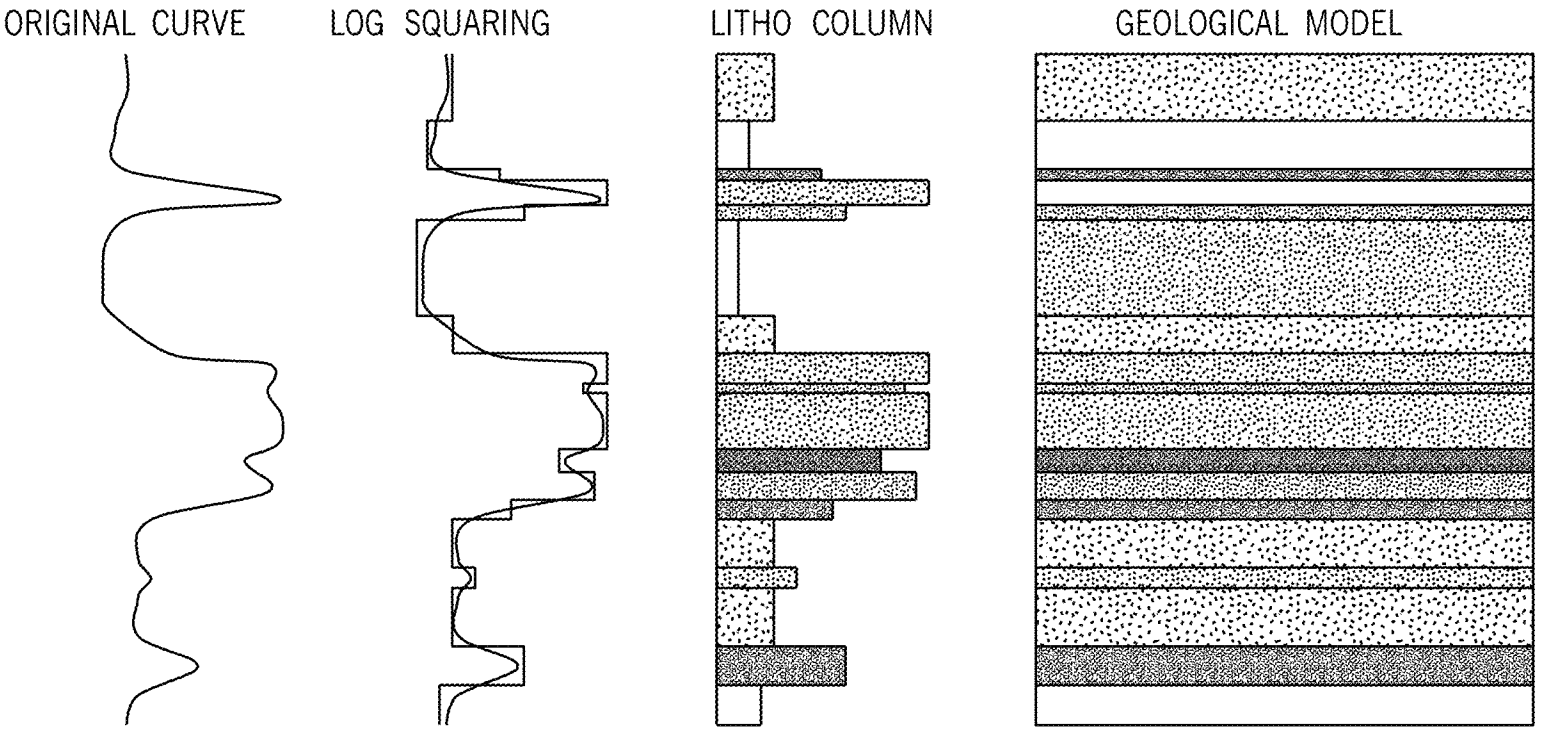
FIG. 14 illustrates a log squaring workflow associated with the workflow of FIG. 8, in accordance with embodiments of the present disclosure.
Figure 15:
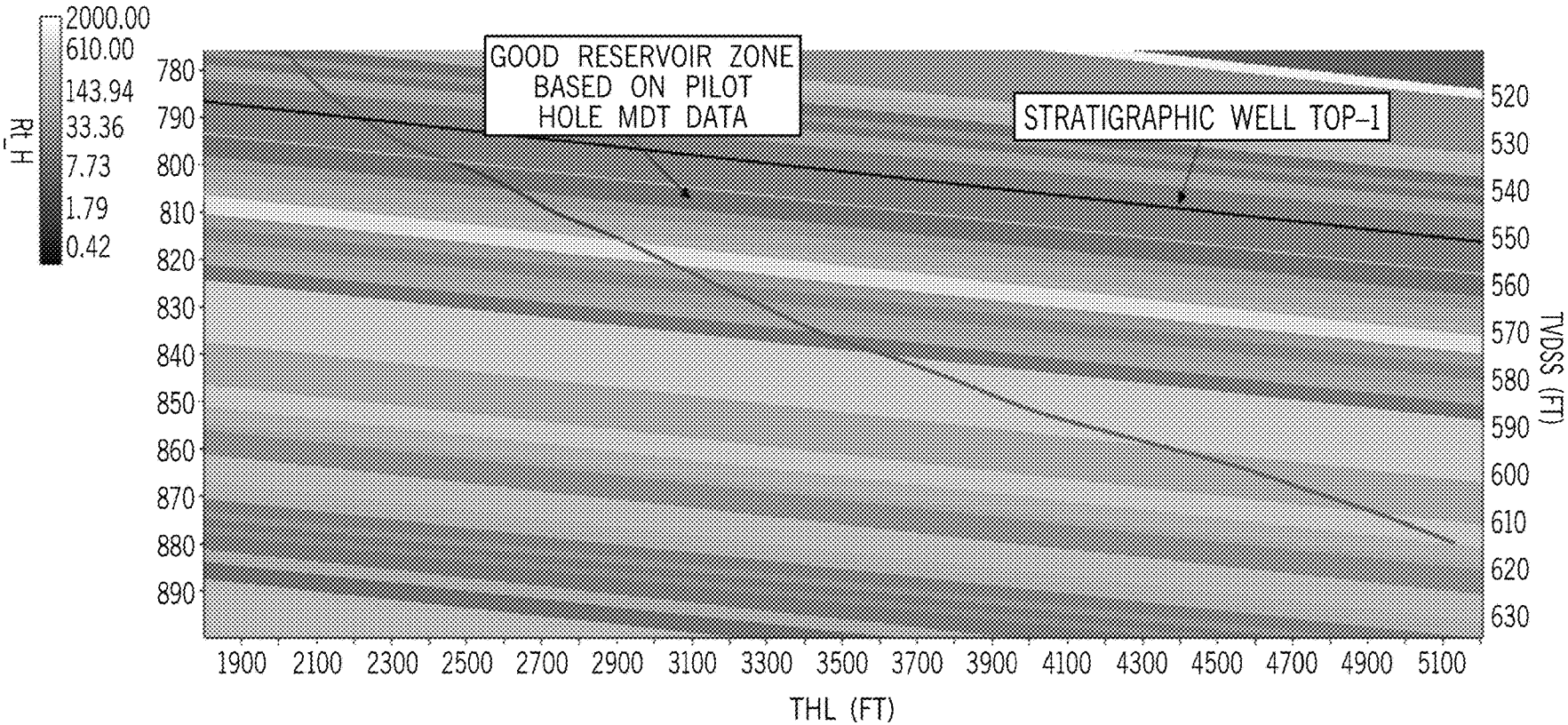
FIG. 15 illustrates a well prolific sublayer along an interval, in accordance with embodiments of the present disclosure.

A full openhole formation evaluation suite was again utilized while drilling the lateral. A one-dimensional MEM was also built for the lateral using the sonic logs and calibrated pore pressure models from the pilot hole. This was important for appropriate cluster selection design. The lateral log was then inspected for reservoir quality indicators (RQI) and variations such as porosity, permeability, and water saturation. These were discretized and combined with completion quality indicators (CQI) such as horizontal stress and Young's modulus to create a composite index across the lateral. Finally, it was decided to complete with eight stages with two perforation clusters per stage (e.g., as illustrated in FIG. 13) using the criteria below:

Sufficient cluster spacing of 100 to 120 foot was planned to minimize the stress shadow effect from competing fractures.

Final cluster depths were adjusted based on casing collar and centralizer locations analyzed from wireline logs. These completion elements can exacerbate near-wellbore admittance issues.

A low stress contrast differential for the clusters was desired to eliminate single dominant fracture propagation.

Similar lithology was considered for the cluster placement.

In FIG. 13, the curves are, top to bottom: porosity, stress gradient, openhole logs, RQI, CQI, composite index, cluster design. In the composite log legend, the first letter is for the RQI, and the second letter is for the CQI; G is for good, and B is for bad.

Fracturing Treatment Design and Execution Highlights

As mentioned above, some of the fracturing parameters were observed to affect the production for the earlier wells, such as the amount of guar polymer, inefficient fracture cleanup, and so forth. So, the next important step in the workflow was to devise a novel fracturing strategy because of a lack of success in cased hole completions. Based on the historical comparative treatment analysis, potential issues such as guar polymer damage, fracture cleanup efficiency, and so forth, were discovered. Three different techniques were used to target these issues. The injection rate and fluid leakoff was used to select the appropriate design for specific stages for a candidate. A hybrid treatment with slickwater was used in stages 1 and 4. The approach combined high rate slickwater treatment at the beginning and low guar loading crosslinked gel at the end of the treatment. This approach allowed for reduction of the volume of crosslinked fluid pumped to place proppant and significantly increased the fracture half-length as a result of using low viscous slickwater fluid with low proppant concentration ramps. Stage 1 finished with near-wellbore screenout when larger proppant (e.g., 20/40 mesh) hit perforations at the end of the treatment. Hybrid design was then modified based on this result and stage 4 was successfully placed as per modified design with smaller size proppant (e.g., 30/50 mesh). Conventional fracturing with reduced gel (e.g., guar-based) loading was implemented in stages 2, 3, 5, and 7. 25 to 30 pounds/gallon crosslinked gel was used in these stages in contrast to 35 to 40 pounds/gallon gel that was utilized in all stages in Well-C and Well-D. The reduced polymer loading is expected to help improve flowback of treating fluids due to reduced fracture damage. Stage 6 was skipped due to limited injectivity. Finally, $CO_2$ FoamFRAC design with novel biopolymer-based linear fracturing fluid was implemented in stage 8 (e.g., the last stage). There are multiple benefits of using $CO_2$ foam as fracturing fluid, such as reduced proppant pack damage due to reduction in volume of fracturing fluid, improved flowback due to energy provided by $CO_2$ expansion, reduction in interfacial tension between fracturing fluid and hydrocarbons, and so forth. The proppant in this stage was cut earlier due to significant pressure increments, which can be related to low fracturing width generated by low viscosity fracturing fluid. However, around 50,000 pounds of proppant were successfully placed in the reservoir with a final concentration of approximately 2.5 pounds of proppant added (PPA).

Production Log Analysis

The well flowed naturally after fracturing. All the isolation plugs were milled out, and a production logging tool (PLT) using flow scanner imaging technology was conducted to assess the production contribution of each stage. In particular, the production fractions for each stage (having various treatment types, such as $CO_2$ foam, low guar fluid, slickwater hybrid, and so forth) was evaluated. The last two stages showed the best flow fractions with a total production contribution of 97% to 98%, which can also be seen in conjunction with the reservoir development along the lateral (e.g., as illustrated in FIG. 13) as well as the pilot hole sampling to comprehend the production performance. The PLT analysis found that all flowing clusters were still producing water, indicating that the fracture cleanup phase was not entirely completed.

Sonic Noise Log Analysis

After the flow scanner imaging analysis, a secondary flow analysis was conducted using a sonic noise log (SNL). The SNL tool was developed to analyze the acoustic flow signals behind the casing/liner. The algorithm and interpretation give the contribution to production of each stage. The principle is that fluid movement through reservoir rock or completion leaks produces noise. The linear correlation of the noise amplitude with rate is then exploited for flow measurements. The SNL tool records high-frequency acoustic signals of 8 Hz to 60 Hz.

A detailed analysis and interpretation of the flow was performed based on the high-precision temperature acquisition and acoustic spinner signals. The high-precision temperature SNL was first used to detect any completion anomalies that can affect subsequent production interpretations. No well integrity issue or communication behind the liner was identified in either shut-in or flowing conditions. Across stage 7, cluster 2, and stage 8, cluster 1, intensification of the noise was seen, indicating relatively high flow rates. Also, the temperature gradient change across the chief active zones aids in integrated interpretation. Stage 8 showed 70% of total production, and stage 7 showed 24%, compared to 71% and 27%, respectively, from the flow scanner imaging production log.

Production Comparison: Closing the First Loop

The production log evaluation showed that Well-A was successful, but the stage contributions showed that a high fracture conductivity was not achieved across full fracture height away from the wellbore. This explains the low production for the initial stages. Following from Table 1 above, where the initial study and strategy building started, the lateral landing, stimulation approach was improved, and the results showed normalized gas rates and flowing wellhead pressures (FWHP) at the same surface choke size of 0.375 inch. The target of this exploration exercise was to mimic the production performance of well B, but with the diagnostics and appropriate measures put in place, the production far exceeded that of Well-B and the overall expectation based on commercial gas rate. The overall highlights of the differentiation, some or most of which aided in Well-A success, are listed below:

Completion of the well as open hole with packers and sleeve as was done in Well-B was not possible due to the overall hole quality experienced during drilling.

Wellbore orientation was designed to induce more longitudinal fractures.

More fractures were placed compared to the offset wells with cemented liners. Fractures were successfully placed in 14 clusters along the lateral, yielding a much higher fracturing density.

The lateral was landed in layer-1, similar to Well-B.

Openhole downhole sampling was used in the pilot hole even within layer 1 to see prolific sublayers.

Fracturing was performed with novel treatment approaches such as $CO_2$ foam utilization, slickwater, and so forth.

Second Phase: Development

The success of Well-A supported the development of the area by new horizontal wells drilling into layer-1 followed by multistage fracturing. Three more wells were completed and fractured using different approaches, and all of the wells showed good sustained production rates after fracture cleanup. However, the production performance was still not very consistent among all the wells, especially Well-E and Well-G showing relatively lower gas rates (see, e.g., Table 2 below). Also, the production log on Well-A showed a 97% to 98% flow fraction coming from the top two stages closer to the heel. These were also the intervals closest in measured depth to the good mobility point chosen as a marker for lateral landing point to enter the desired reservoir sublayer.

TABLE 2

Offset summary in appraisal phase.

| | Completion Method | Proppant Placed Stages | Planned Stages | Differential Azimuth [deg] | Normalized Gas Rate | Normalized Flowing Wellhead Pressure |
|---|---|---|---|---|---|---|
| Well-A | Plug and perf | 7 | 8 | 28 | 1.00 | 1.00 |
| Well-E | Plug and perf | 5 | 8 | 23 | 0.29 | 0.28 |
| Well-F | Openhole multistage fracturing | 7 | 8 | 60 | 0.79 | 0.77 |
| Well-G | Plug and perf | 10 | 10 | 29 | 0.47 | 0.53 |

Need for an Integrated Lookback

Considering the challenges of achieving good fracture conductivity across the fracture height away from the wellbore and disparity in the production performance among different wells, further steps were investigated. In particular, it was decided to build the lateral trajectory model correlations through a two-dimensional curtain section with geological layering. All of the acquired log data, fracturing treatment evaluation, and other information can be put together with this lateral trajectory model to comprehend the production performance.

Building a Two-Dimensional Curtain Section for Correlation

The correlation model is built based on the model compare and update technique. The main steps of the two-dimensional curtain section generation and interpretation workflow are outlined in the steps below and illustrated in FIG. 8:

Step 1: Generate a composite plot from the log data and visually examine it. Identify zones of interest and problematic intervals. Resistivity data is typically presented in borehole compensated form, removing the effect of rugosity. The resistivity tool code is well developed, enabling algorithms to simulate synthetic resistivity logs in complicated formation geometries. Hence, the correlation based on this log is easy to duplicate.

Step 2: Create offset well "squared log" data propagated through a two-dimensional model canvas. The variations in resistivity values are represented as a graduated color spectrum (see, e.g., the log squaring workflow illustrated in FIG. 14).

Step 3: Generate a two-dimensional cross-section forward model to simulate the rock properties causing the observed responses. The model is an interpretive construct that enables simulation of the tool responses along the drilled trajectory in a two-dimensional layered earth petrophysical model. The available starting point for modeling is a local electrical stratigraphy derived from an offset. Alternatively, the $R_t$ outputs of the previous automated interpretation may be converted to a true stratigraphic thickness/true vertical depth (TST/TVD) column.

Step 4: The property model allows flexibility to the interpreter. The initial model in this workflow is based on a flat geological model.

Step 5: After a preliminary property model is generated, a procedure of correlation and structural interpretation is conducted. The model software projects a true horizontal length indexed projection of the property log overlaying the actual logging-while-drilling log responses. Through a systematic process of identifying correlations between the property log and the logging-while-drilling log, then making a series of modifications to the model, the structure takes shape; at this stage, appropriate information from image-derived apparent dips and bed boundaries pinpointed from higher resolution logs is utilized.

Step 6: After a plausible basic structure is generated, the next process is to fine-tune the property model using two-dimensional forward modeled simulations of the curves for detailed comparison with the actual logging-while-drilling measurements. The two-dimensional modeling code employed allows simulation of the effects of multiple beds of differing isotropic or anisotropic resistivities on each of the tool measurements, accounting for the differing geometrical factors of each measurement and for the variations in the relative angle between the borehole and pole to bedding. Multiple iterations of model modification are performed, involving editing of the properties and or minor translations and rotations of segments of the model. Each model modification is followed by forward modeling and comparison of the simulated and actual curves.

Well Placement—Production Correlation

Since it was not completely comprehendible what sublayers the lateral traversed because there was a lack of analysis of trajectory vs. geology, the process described in the previous section aided in the implementation of the second phase of this study to better understand gas production based on the precise lateral landing of each well detailed in Table 3. A well log correlation and two-dimensional cross-section were built for each of the wells in this phase as detailed above to place the lateral across the stratigraphic structure dip. Below were the steps followed for this exercise:

1. Analyze the most prolific sublayer starting from the pilot hole formation sampling and then correlating with the production log conducted in Well-A.

2. Build the two-dimensional curtain section for Wells E, F, and G to comprehend the relative location of this prolific zone with the lateral trajectory.
3. Place the fracturing stage intervals along the lateral and predict which stages were landed in the desired reservoir zone.
4. Interpret the production performance based on the lateral landing and stage placement.

TABLE 3

Lateral landing analysis integrated with productivity index (PI).

| | Normalized Gas Rate | Normalized FWHP | Normalized PI | Lateral length in target/total lateral length [%] | Vertical Separation [ft] | Proppant Fractured Clusters/Intervals (Normalized) |
|---|---|---|---|---|---|---|
| Well-A | 1.00 | 1.00 | 1.00 | 22 | NA | 1.00 |
| Well-E | 0.29 | 0.28 | 0.14 | 0 | 60 | 0.36 |
| Well-F | 0.79 | 0.77 | 0.52 | 13 | NA | 0.50 |
| Well-G | 0.47 | 0.53 | 0.27 | 0 | 45 | 0.71 |

It should be noted that one advantage of the embodiments described herein is that the well log correlation and two-dimensional cross-section that were built take into consideration Both, fraction of the lateral length fraction intersecting a target layer and vertical separation of the lateral from the target layer along its length, which aids the determination and guidance of optimal lateral landings.

Step 1: Well-A Baseline Evaluation

It was found that most production for Well-A came from stages 7 and 8. By correlating the dip from the pilot hole and integrating that with the producing intervals along the lateral, the 20-foot vertical net pay interval, with a net to gross of 0.14, was traced to approximately 10 to 15 feet below the stratigraphic well top 1 (see, e.g., FIG. 15). This interpretation was then taken to the next step.

Step 2: Offset Wells Trajectory Interpretation

Figure 16A:
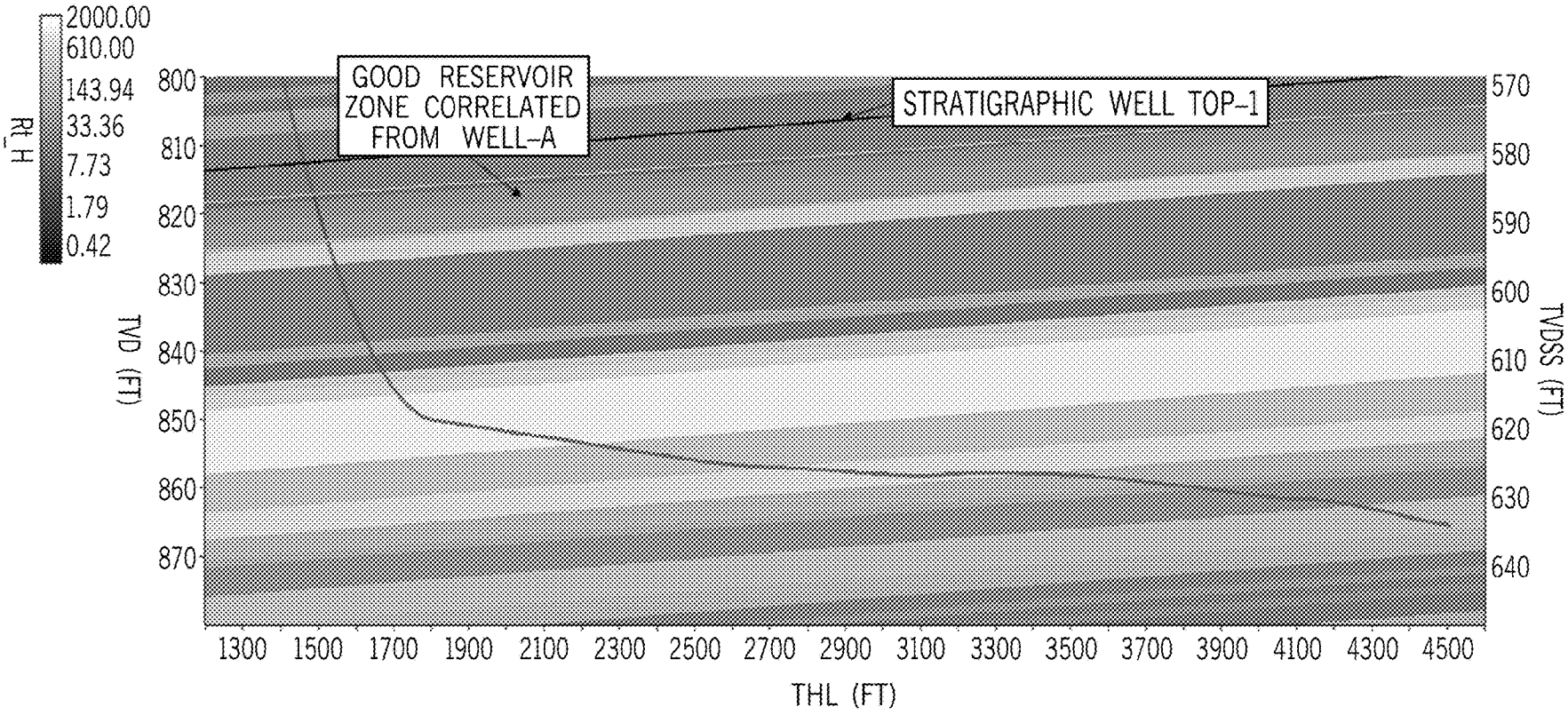
FIGS. 16A, 16B, and 16C illustrate two-dimensional cross-section resistivity correlation for various wells, in accordance with embodiments of the present disclosure.
Figure 16B:
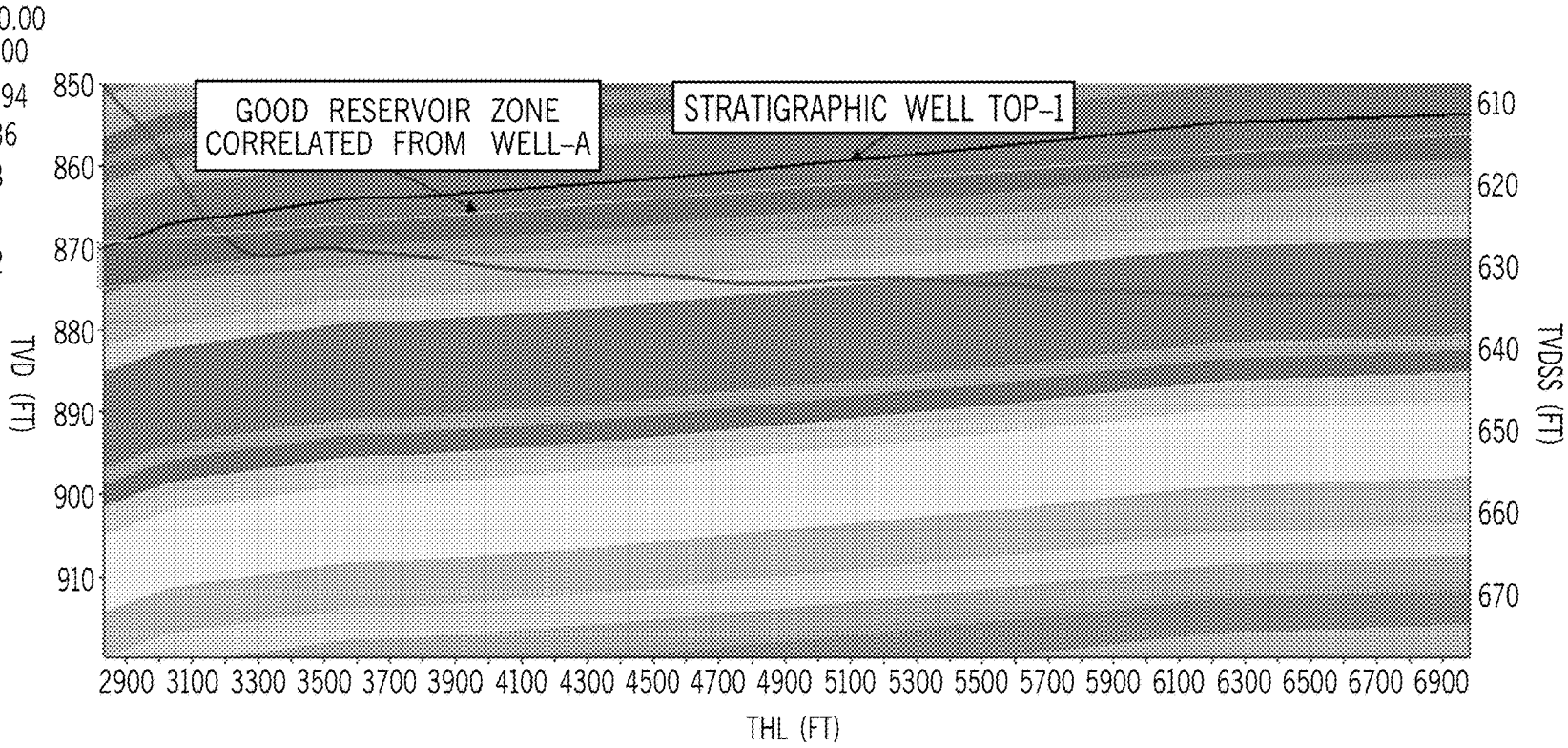
Figure 16C:
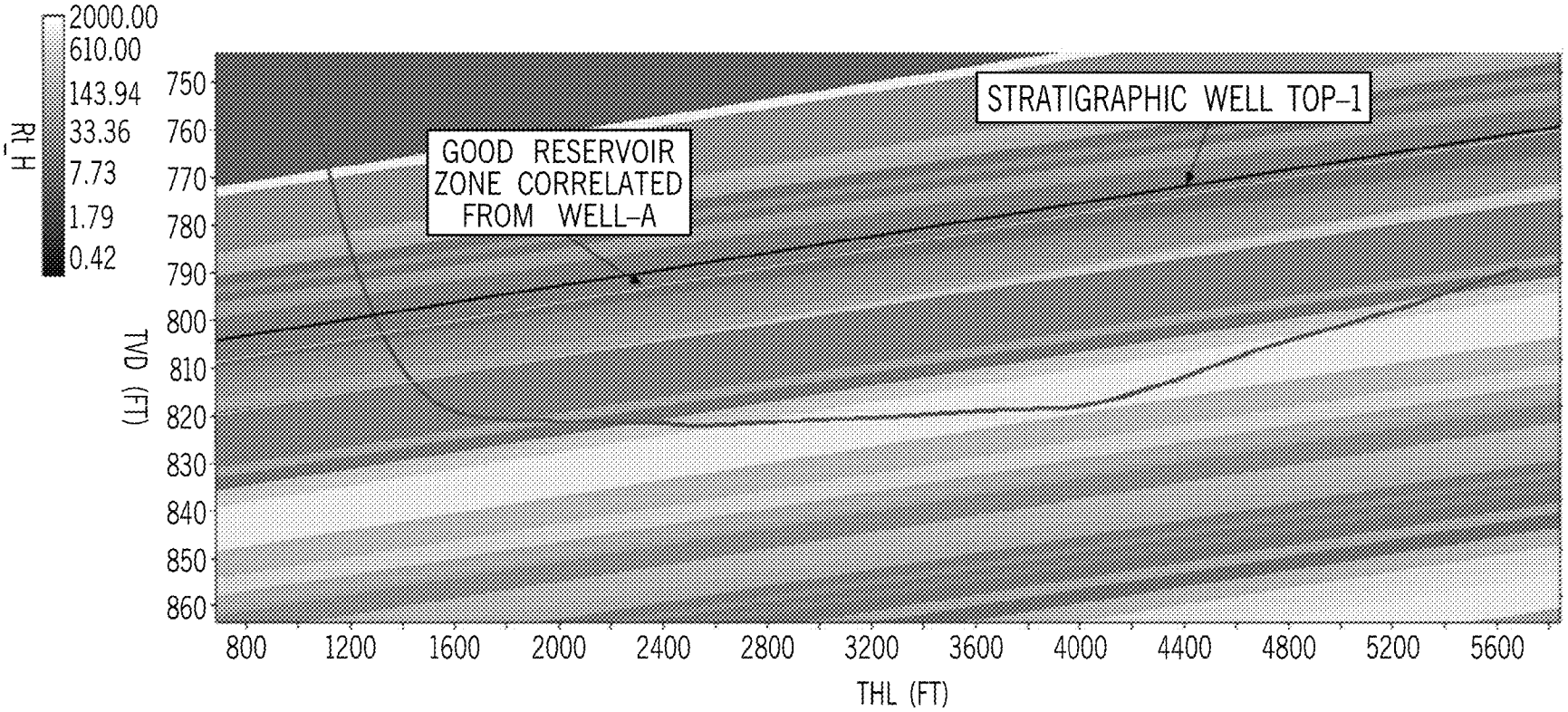

A horizontal well cross section for the offset Wells E, F, and G was built from the Well-A synthetic resistivity property model. Based on the correlation, the light blue highlight in FIGS. 16A, 16B, and 16C show the desired reservoir interval for lateral landing of Well-E, Well-F, and Well-G, respectively. As illustrated in these figures, Well-F has the best lateral landing, wherein the top part of the lateral completely intersects the sublayer, and the lower part of the lateral is within 20 to 30 feet. Therefore, the fracture height can connect this sublayer to the wellbore. Well-E seems to have a relatively undesirable lateral landing, with no part of the lateral intersecting the desired sublayer, and also the vertical distance is more than 50 feet away. Well-G seems to miss the desired sublayer but not by a long vertical depth. In summary, the best to worst relative lateral landing based on correlation is Well-F, followed by Well-G, and finally Well-E. A comparison of the relative normalized production parameters in Table 4 shows the interpretation ties in very well with the actual production performance.

Step 3: Productive Interval Analysis

Figure 17:
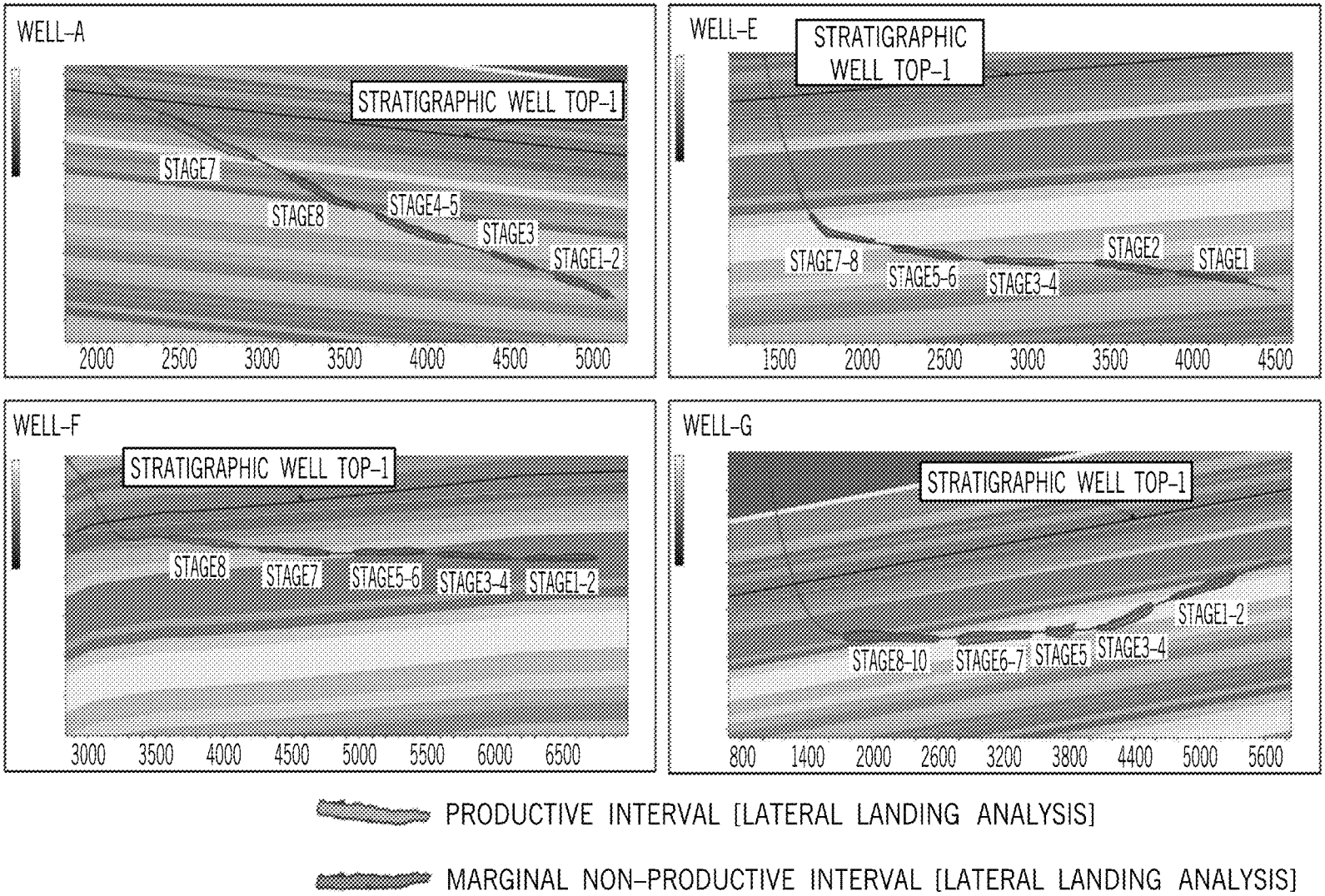
FIG. 17 shows fracturing stage interval sections and classifies the productive and marginal or nonproductive stage intervals based on their intersection with a desired sublayer, in accordance with embodiments of the present disclosure.

FIG. 17 shows the fracturing stage interval sections and classifies the productive and the marginal or nonproductive stage intervals based on their intersection with the desired sublayer. This analysis is mainly based on the fact that the Well-A production log showed most flow fractions from the stage intervals that intersected completely with the prolific sublayer. The stages are shown as sections instead of specific depth points. This is valid for Well-F, which is an openhole well completed with isolation packer and fracturing sleeves. However, it is also valid for Well-A, Well-E, and Well-G, which are plug and perf multi-cluster completions because none of the wells had the lateral orientation favorable for completely transverse fracture propagation.

Step 4: Explainable Production Correlation

As briefly described in step 2 of this workflow, the best-to-worst lateral landing correlation corroborates the production performance if we were to rank the wells. It was seen that the productivity index (PI) depends on the lateral landing intersection of the prolific sublayer and also the vertical distance between the two. Another influential parameter is the successful placement of propped fractures. The case of undesirable landing, Well-G with ten fracturing stages, shows better performance than Well-E. Fewer stages can be planned for openhole completions because there is a natural tendency of multiple fracture propagation in such a fracturing environment, depending on other factors. Moreover, reservoir rock connection with the wellbore is better due to the openhole exposure.

Even though the conundrum of gas production boost was resolved through the evaluation phase, the second phase of lateral landing analysis showed the potential to further exploit the productivity in this field. Proper well placement techniques by sidetracking the well in the analyzed prolific reservoir zone must be considered to further enhance the production. The less prolific zones in layer-2 show potential hydrocarbons from the petrophysical evaluation. These intervals need to be completed and exploited with a more unconventional play approach with much higher fracturing stages, larger fluid volumes, and so forth. For all the strategies in different areas, a recent geosteering technique using ultradeep resistivity measurement may be employed to continuously map the top of reservoir/stratigraphy and maintain the well in the desired reservoir sublayer.

Figure 18:
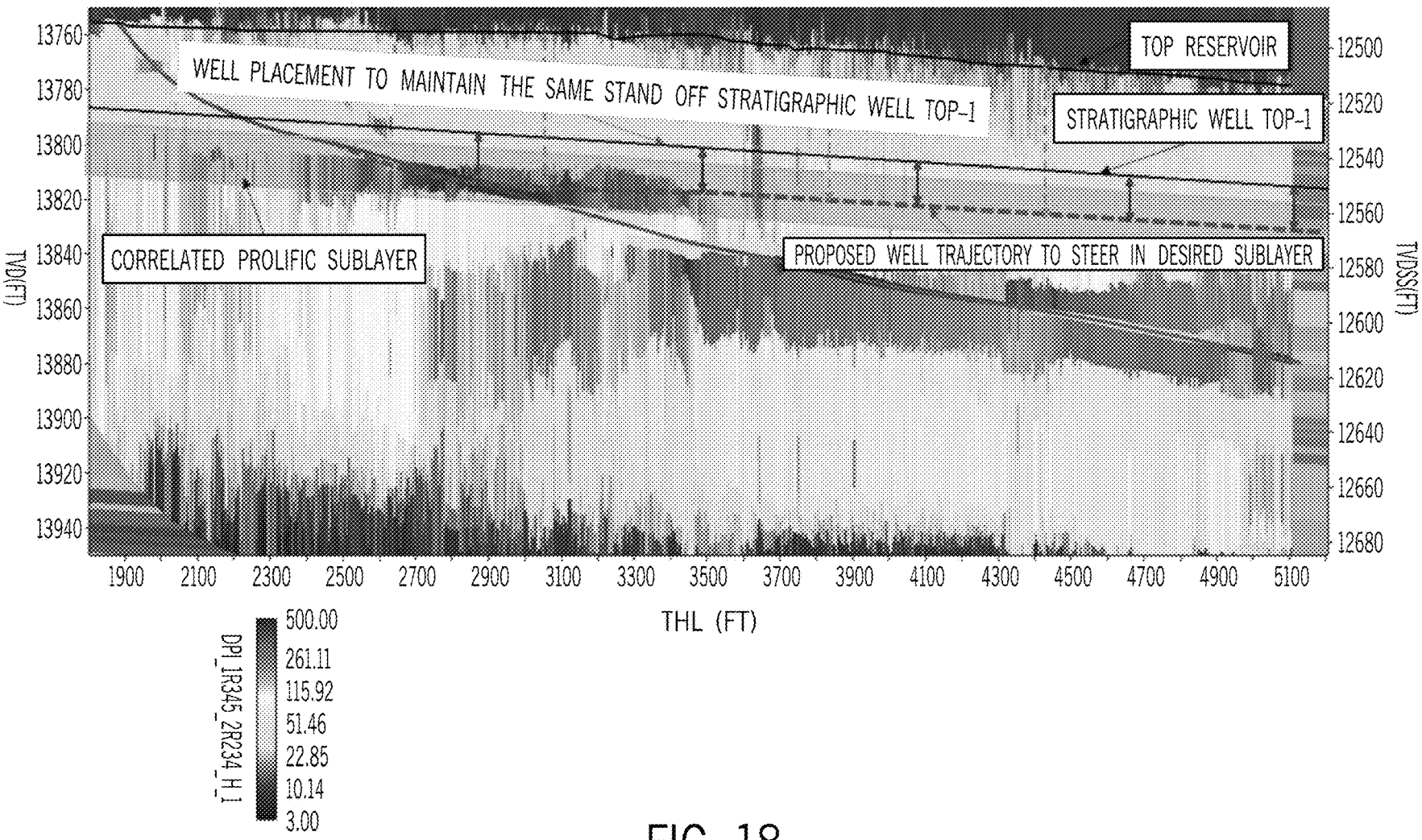
FIG. 18 shows a log generated from an ultradeep azimuthal resistivity tool incorporated into a drill string, in accordance with embodiments of the present disclosure.

FIG. 18 shows such a log generated from an ultradeep azimuthal resistivity tool incorporated into the drill string. The simulation was based on a two-dimensional cross section built as per the workflow given in FIG. 8 conducted for Well-A. A forward model was generated based on the propagated two-dimensional resistivity curtain section. The model generated a large number of curves to be inverted to map the formation layers at the vicinity of the wellbore within the tool depth of investigation. The downhole tool responds with high sensitivity to the formation resistivity layer contrast. The modeling and inversion result, it allows an engineer to check the tool feasibility with respect to the formation contrast. In the case of the evaluation of these wells, the downhole tool is able to detect/map the unconformity layer above the trajectory up to 100 foot depth of investigation. With this capability, it allows the geosteering process decision to be maintained at the sweet spot/desired target that was determined based on offset area analysis. The simulation in FIG. 18 shows the predicted drilling path that can be achieved in real time, a technology that can be applied to exploration fields in the future.

From a fracturing perspective, based on the post-fracturing net pressure match, the longest fractures were seen to be generated by slickwater hybrid and foam fracturing treatments. Different fracturing approaches and technologies may be tried to establish production benefits. If the lateral cannot be landed close to the desired trajectory, fracture height growth should be relatively important. Crosslinked fluid may be used instead of slickwater systems. A challenge is to achieve high fracture conductivity across the full laminated net pay. The laminations tend to cause fracture height containment and cause pinch points. An action that could be used is to design more aggressive fracturing treatments with some extent of tip screenout (TSO) to prop the full fracture height and maintain good conductivity further away from the wellbore. So far, it has been difficult to place aggressive treatment designs due to the treating pressure limitations. Most stages experienced 18,000-20,000 psi bottomhole treating pressures.

In multiple cluster plug-and-perf completions, particulate diverting agents may enhance stimulation efficiency and lateral coverage. Although the success of $CO_2$ foam fracturing in Well-A with approximately 70% of flow contribution is evident, it is unclear what part of the success could be attributed to the reservoir quality due to the lateral landing. For further comprehension on this subject, more candidates should be treated with $CO_2$ foams so a production dependence can be established.

With sufficient wells completed and fractured, a data science/machine learning approach may be applied to automate the processes of lateral landing, completion, and fracturing design/execution plans. A structured database may be developed for an exploration well workflow and may be used with several algorithms for this project.

Integrated technologies followed by engineering correlation models aided in analyzing the most prolific sublayer in reservoir zone layer-1. Production analysis showed the dependence on the lateral intersection with the desired sublayer, vertical distance between them, and number of fracturing stages placed. Although the fracture height based on simulation shows a hydraulic connection with the desired reservoir, the conductivity further away from the wellbore is relatively low, which affects the production contribution. The direct wellbore connection with the prolific reservoir precedes the hydraulic fracture connection. However, hydraulic fractures and the number of fractures play a crucial role in getting the best return on investment for these wells. Other parameters studied that showed lower dependence were the completion type, with openhole being a better choice. Another parameter is the differential azimuth, wherein a lower planar difference between the preferred fracture plane and wellbore seems to be better. Successful placement of proppant with slickwater was proven in three wells and with $CO_2$ foam in one well. $CO_2$ was shown to enhance the fracture cleanup, with Well-A showing the lowest time period required to achieve the cleanup criteria.

The objective of identifying the importance of precise well placement point and rendering productive completions in the area through a comprehensive workflow was effectively conducted and analyzed as per the workflow 68 illustrated in FIG. 6. Openhole logs are a good starting point in such exploration, but many unpredictable situations arise during the production phase. Therefore, the analysis and evaluation at each step is critical. Six wells, three on each side of Well-A, were studied in detail, and systematic findings were presented in this paper ready for implementation. Moreover, it provides a strong framework for similar future developments.

Figure 19:
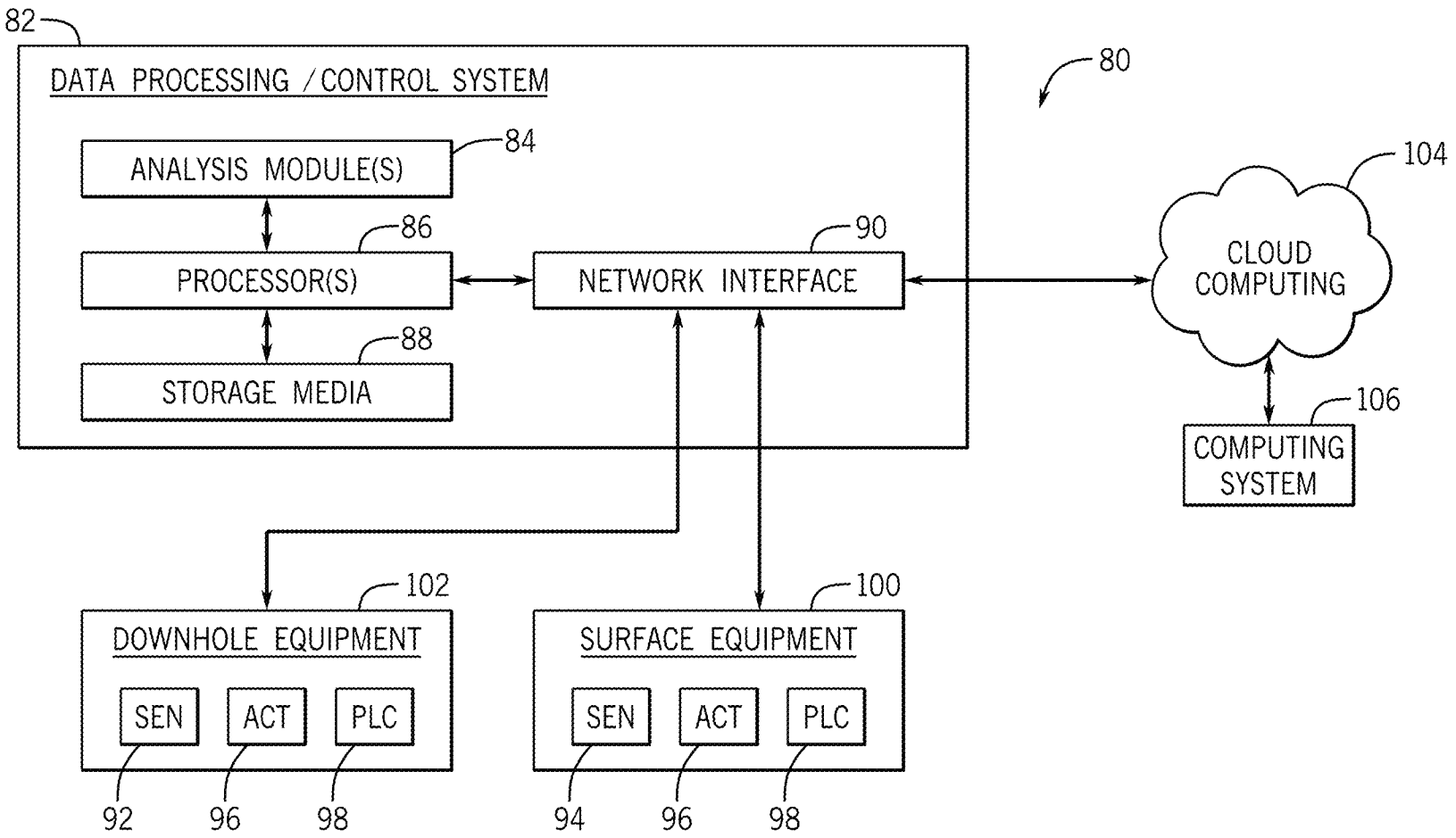
FIG. 19 illustrates an example well control system configured to control the well completion systems as described herein, in accordance with embodiments of the present disclosure.

FIG. 19 illustrates an example well control system 80 configured to control the well completion systems (e.g., as illustrated in FIGS. 3-5) as described in greater detail herein. As illustrated, in certain embodiments, the well control system 80 may include a data processing and control system 82 to control the well completion systems described herein. In certain embodiments, the data processing and control system 82 may include one or more analysis modules 84 (e.g., a program of computer-executable instructions and associated data) that may be configured to perform various functions of the embodiments described herein. In certain embodiments, to perform these various functions, an analysis module 84 executes on one or more processors 86 of the data processing and control system 82, which may be connected to one or more storage media 88 of the data processing and control system 82. Indeed, in certain embodiments, the one or more analysis modules 84 may be stored in the one or more storage media 88.

In certain embodiments, the one or more processors 86 may include a microprocessor, a microcontroller, a processor module or subsystem, a programmable integrated circuit, a programmable gate array, a digital signal processor (DSP), or another control or computing device. In certain embodiments, the one or more storage media 88 may be implemented as one or more non-transitory computer-readable or machine-readable storage media. In certain embodiments, the one or more storage media 88 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 84 may be provided on one computer-readable or machine-readable storage medium of the storage media 88, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 88 may be located either in the machine running the machine-readable instructions, or may be located at a remote site from which machine-readable instructions may be downloaded over a network for execution.

In certain embodiments, the processor(s) 86 may be connected to a network interface 90 of the data processing and control system 82 to allow the data processing and control system 82 to communicate with various downhole sensors 92 and surface sensors 94 described herein, as well as communicate with actuators 96 and/or PLCs 98 of surface equipment 100 (e.g., pump units, flowback equipment, and so forth) and of downhole equipment 102 (e.g., bottomhole assemblies, downhole motors, drill bits, downhole well tools, and so forth) for the purpose of controlling operation of well completion systems, as described in greater detail herein. In certain embodiments, the network interface 90 may also facilitate the data processing and control system 82 to communicate data through a suitable wired and/or wireless communication network 104 to, for example, archive the data and/or to enable external computing systems 106 to access the data.

It should be appreciated that the well control system 80 illustrated in FIG. 19 is only one example of a well control system, and that the well control system 80 may have more or fewer components than shown, may combine additional components not depicted in the embodiment of FIG. 19, and/or the well control system 80 may have a different configuration or arrangement of the components depicted in FIG. 19. In addition, the various components illustrated in FIG. 19 may be implemented in hardware, software, or a combination of both hardware and software, including one or more signal processing and/or application specific integrated circuits. Furthermore, the operations of the well control system 80 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described in greater detail herein, the embodiments described herein facilitate the operation of well completion systems. For example, a variety of data (e.g., downhole data and surface data) may be collected to enable optimization of operations of well-related tools by the data processing and control system 82 illustrated in FIG. 19 (or other suitable processing system). In certain embodiments, the data may be provided as advisory data by the data processing and control system 82 (or other suitable processing system). However, in other embodiments, the data may be used to facilitate automation of downhole processes and/or surface processes (i.e., the processes may be automated without human intervention), for example, related to geosteering of laterals formed by downhole well tools, as described in greater detail herein, by the data processing and control system 82 (or other suitable processing system). The embodiments described herein may enhance downhole operations by improving the efficiency and utilization of data to enable performance optimization and improved resource controls.

In particular, as described in greater detail herein, downhole parameters may be obtained via, for example, downhole sensors 92 while associated downhole well tools are disposed within a wellbore. In certain embodiments, the downhole parameters may be obtained in substantially real-time and sent to the data processing and control system 82 via wired or wireless telemetry. In addition, in certain embodiments, downhole parameters may be combined with surface parameters by the data processing and control system 82. In addition, in certain embodiments, the downhole and surface parameters may be processed by the data processing and control system 82 during use of certain downhole well tools to enable automatic (e.g., without human intervention) optimization with respect to use of the downhole well tools during subsequent stages of operation of the downhole well tools.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible, or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

The invention claimed is:

1. A method, comprising:

conducting a parametric production study for a plurality of wells during a development phase of the plurality of wells in a geological environment;

deploying information relating to the parametric production study for use in design of an additional well;

drilling a pilot hole as a portion of the additional well;

conducting a pilot hole analysis for the additional well;

generating a lateral landing workflow based at least in part on the pilot hole analysis for the additional well;

sidetracking a first lateral based upon a lateral landing point selected in conjunction with the lateral landing workflow;

analyzing production intervals of the plurality of wells and the additional well to determine a first production interval, wherein the first production interval is determined based on an amount of intersection between a production interval and a productive sublayer derived from the pilot hole analysis;

analyzing production dependence of the plurality of wells and the additional well on precise lateral landing;

identifying a precise sublayer for lateral landing based at least in part on the first production interval and the production dependence; and geosteering a second lateral of the additional well without human intervention and in accordance with information relating to the precise sublayer for lateral landing to a precise lateral landing point associated with the precise sublayer, wherein geosteering the second lateral of the additional well comprises adjusting a longitudinal location and a rotational orientation of a deflecting device within the additional well to direct a drilling, cutting, or boring device towards the precise lateral landing point.

2. The method of claim 1, wherein the parametric production study comprises well placement, fracturing strategy, completion type, or some combination thereof, for the plurality of wells.

3. The method of claim 1, wherein the information relating to the parametric production study comprises downhole sampling, one or more production logs, one or more noise logs, fracturing approach, or some combination thereof, for the plurality of wells.

4. The method of claim 1, wherein the development phase of the plurality of wells comprises an explorational phase, an appraisal phase, another asset development phase, or some combination thereof.

5. The method of claim 1, wherein the geologic environment comprises a conventional geologic environment or an unconventional geologic environment.

6. The method of claim 1, wherein identifying the precise sublayer for the lateral landing is based at least in part on lateral length fraction of the first lateral intersecting a target layer and vertical separation of the first lateral from the target layer along a length of the first lateral.

7. The method of claim 1, wherein the lateral landing workflow comprises performance of a geological analysis and correlation, performance of petrophysical correlations, performance of downhole formation testing and sampling, geomechanics and Mechanical Earth Model (MEM) construction, generation of a stimulation design, performance of the lateral landing point selection, generation of an offset wells performance study, or any combination thereof.

8. A well control system, comprising:

one or more processors configured to execute processor-executable instructions stored in storage media of the well control system, wherein the processor-executable instructions, when executed by the one or more processors, cause the well control system to:

conduct a parametric production study for a plurality of wells during a development phase of the plurality of wells in a geological environment;

deploy information relating to the parametric production study for use in design of an additional well;

conduct a pilot hole analysis for the additional well from a drilled pilot hole as a portion of the additional well;

generate a lateral landing workflow based at least in part on the pilot hole analysis for the additional well to sidetrack a first lateral based upon a lateral landing point selected in conjunction with the lateral landing workflow;

analyze production intervals of the plurality of wells and the additional well to determine a first production interval, wherein the first production interval is determined based on an amount of intersection between a production interval and a productive sublayer derived from the pilot hole analysis;

analyze production dependence of the plurality of wells and the additional well on precise lateral landing;

identify a precise sublayer for lateral landing based at least in part on the first production interval and the production dependence; and geosteer a second lateral of the additional well without human intervention and in accordance with information relating to the precise sublayer for lateral landing to a precise lateral landing point associated with the precise sublayer, wherein geosteering the second lateral of the additional well comprises adjusting a longitudinal location and a rotational orientation of a deflecting device within the additional well to direct a drilling, cutting, or boring device towards the precise lateral landing point.

9. The well control system of claim 8, wherein the parametric production study comprises well placement, fracturing strategy, completion type, or some combination thereof, for the plurality of wells.

10. The well control system of claim 8, wherein the information relating to the parametric production study comprises downhole sampling, one or more production logs, one or more noise logs, fracturing approach, or some combination thereof, for the plurality of wells.

11. The well control system of claim 8, wherein the development phase of the plurality of wells comprises an explorational phase, an appraisal phase, another asset development phase, or some combination thereof.

12. The well control system of claim 8, wherein the geologic environment comprises a conventional geologic environment.

13. The well control system of claim 8, wherein the geologic environment comprises an unconventional geologic environment.

14. The well control system of claim 8, wherein identifying the precise sublayer for the lateral landing is based at least in part on lateral length fraction of the first lateral intersecting a target layer and vertical separation of the first lateral from the target layer along a length of the first lateral.

15. A method, comprising:

conducting a parametric production study for a plurality of wells in a geological environment;

deploying information relating to the parametric production study for use in design of an additional well;

drilling a pilot hole as a portion of the additional well;

conducting a pilot hole analysis for the additional well;

generating a lateral landing workflow based at least in part on the pilot hole analysis for the additional well;

sidetracking a first lateral based upon a lateral landing point selected in conjunction with the lateral landing workflow;

placing fracturing stage intervals within the plurality of wells and the additional well, wherein the fracturing stage intervals correspond to production intervals, and wherein the production intervals are derived from the fracturing stage intervals based on a classification of the fracturing stage intervals as productive fracturing stage intervals or non-productive fracturing stage intervals;

analyzing the production intervals of the plurality of wells and the additional well to determine a first production interval, wherein the first production interval is determined based on an amount of intersection between a production interval and a productive sublayer derived from the pilot hole analysis;

analyzing production dependence of the plurality of wells and the additional well on precise lateral landing;

identifying a precise sublayer for lateral landing based at least in part on the first production interval and the production dependence and based at least in part on lateral length fraction of the first lateral intersecting a target layer and vertical separation of the first lateral from the target layer along its length; and geosteering a second lateral of the additional well without human intervention to a precise lateral landing point associated with the precise sublayer identified, wherein geosteering the second lateral of the additional well comprises adjusting a longitudinal location and a rotational orientation of a deflecting device within the additional well to direct a drilling, cutting, or boring device towards the precise lateral landing point.

16. The method of claim 15, wherein the parametric production study comprises well placement, fracturing strategy, completion type, or some combination thereof, for the plurality of wells.

17. The method of claim 15, wherein the information relating to the parametric production study comprises downhole sampling, one or more production logs, one or more noise logs, fracturing approach, or some combination thereof, for the plurality of wells.

18. The method of claim 15, wherein the parametric production study for the plurality of wells is conducted during a development phase of the plurality of wells, and wherein the development phase of the plurality of wells comprises an explorational phase, an appraisal phase, another asset development phase, or some combination thereof.

19. The method of claim 15, wherein the geologic environment comprises a conventional geologic environment.

20. The method of claim 15, wherein the geologic environment comprises an unconventional geologic environment.

* * * * *